US005834155A

United States Patent [19]

Uehara

[11] Patent Number: 5,834,155

[45] Date of Patent: Nov. 10, 1998

[54] IMAGE FORMING PROCESS

[75] Inventor: Kazuki Uehara, Kanagawa, Japan

[73] Assignee: Fuji Photo Film Co., Ltd., Kanagwa, Japan

[21] Appl. No.: 795,564

[22] Filed: Feb. 6, 1997

[30] Foreign Application Priority Data

Feb. 7, 1996 [JP] Japan ..... 8-044053

[51] Int. Cl.[6] ..... G03C 8/40; G03C 8/42; G03C 8/10

[52] U.S. Cl. ..... 430/203; 430/207; 430/403; 430/239; 396/604; 396/609

[58] Field of Search ..... 430/203, 207, 430/236, 239, 403; 396/604, 609

[56] References Cited

U.S. PATENT DOCUMENTS 4,629,675 12/1986 Takehara et al. ..... 430/203
5,135,835 8/1992 Aono et al. ..... 430/203
5,472,821 12/1995 Taguchi ..... 430/203
5,574,530 11/1996 Sanada ..... 396/604

*Primary Examiner*—Richard L. Schilling
*Attorney, Agent, or Firm*—Sughrue, Mion, Zinn, Macpeak & Seas, PLLC

[57] ABSTRACT

An image forming process comprising the steps of: imagewise-exposing a heat developable light-sensitive material comprising a support having thereon at least a light-sensitive silver halide, a binder and a dye-donating compound, wherein the dye-donating compound forms or releases a diffusive dye corresponding or reversely corresponding to a reduction reaction of the silver halide into silver; supplying water to the exposed material; heat developing the water-supplied material to form a diffusive dye image therein; and transferring the diffusive dye image onto a dye-fixing element, wherein the water-supplying step comprises jetting of a water droplet having a volume of not more than 0.01 $mm^3$, and the light-sensitive material has a contact angle of not more than 50 degrees as determined at 0.5 second after the impact of the water droplet onto the light-sensitive material.

3 Claims, 7 Drawing Sheets

IMAGE FORMING PROCESS

FIELD OF THE INVENTION

The present invention relates to an image forming process using a heat developable light-sensitive material.

BACKGROUND OF THE INVENTION

Many processes for obtaining color images by heat development have been proposed.

For example, processes for forming a color image by bonding of a coupler and an oxidant of a developing agent formed by reduction of a silver halide are described in U.S. Pat. Nos. 3,531,286, 3,761,270 and 4,021,240, Belgian Patent No. 802,519 and *Research Disclosure* (hereinafter abbreviated as "RD") 13742.

Further, processes for forming a positive color image by heat development according to a silver dye bleaching process using a silver halide are described in U.S. Pat. No. 4,235,957, RD 14433 and RD 15227.

Furthermore, proposed are processes comprising forming or releasing a diffusible dye imagewise from dye-donating compounds in accordance with heat development of a silver halide, and transferring the diffusive dyes onto a dye-fixing element having a mordant through a solvent such as water, or transferring onto a dye-fixing element by a high boiling organic solvent, or transferring onto a dye-fixing element by a hydrophilic heat solvent contained incorporated in the element, and processes in which the mobile dye thus formed or released is thermally diffusive or undergoes sublimation, and are transferred onto a dye-receiving element such as a support.

In these processes, a dye image negative or positive to an original can be obtained by changing the kind of the dye-donating compound used or the silver halide emulsion, as described, for example, in U.S. Pat. Nos. 4,463,079, 4,474,867, 4,478,927, 4,507,380, and 4,500,626, JP-A-58-149046 (the term "JP-A" as used herein means an "unexamined published Japanese patent application"), JP-A-58-149047, JP-A-59-152440, JP-A-59-154445, JP-A-59-165054, JP-A-59-180548, JP-A-59-168439, JP-A-59-174832, JP-A-59-174833, JP-A-59-174834, JP-A-59-174835, JP-A-62-65038, JP-A-61-23245, EP 210,660 A2 and EP 220,746 A2.

Conventional water-coating systems (for example, a water-coating system described in JP-A-7-261353) have a problem that various agents contained in a light-sensitive material are eluted in water to contaminate water, due to immersion of the light-sensitive material in water for a predetermined period of time.

This problem can be solved by changing the water-coating system to a supplying method by jetting a minute water droplet (hereinafter referred to as a "jet-water-coating system") for avoiding immersion of the light-sensitive material in water. However, processing by the jet-water-coating system raises a new problem that water coating becomes uneven, resulting in generation of uneven density in final images.

SUMMARY OF THE INVENTION

It is therefore an object of the present invention to provide an image forming process reduced in density unevenness in the above-described jet-water-coating systems.

Other objects and effects of the present invention will be apparent from the following description.

The above objects of the present invention has been achieved by providing:

(1) an image forming process comprising the steps of:

imagewise-exposing a heat developable light-sensitive material comprising a support having thereon at least a light-sensitive silver halide, a binder and a dye-donating compound, wherein the dye-donating compound forms or releases a diffusive dye corresponding or reversely corresponding to a reduction reaction of the silver halide into silver;

supplying water to the exposed material;

heat developing the water-supplied material to form a diffusive dye image therein; and transferring the diffusive dye image onto a dye-fixing element, wherein the water-supplying step comprises jetting of a water droplet having a volume of not more than 0.01 $mm^3$, and the light-sensitive material has a contact angle of not more than 50 degrees as determined at 0.5 second after the impact of the water droplet onto the light-sensitive material; and (2) the above described image forming process of (1);

wherein the process is carried out while conveying the heat developable light-sensitive material, and wherein the water-supplying step is conducted by using a water coating apparatus comprising:

(A) a tank for reserving water, which tank has a side wall facing to the conveying path of the heat developable light-sensitive material;

(B) a nozzle which is incorporated in the side wall of the tank, and comprises a plurality of nozzle holes for jetting water, the nozzle holes being linearly arranged at a definite interval along a direction intersecting the conveying direction of the heat developable light-sensitive material; and (C) an actuator for moving the nozzle toward the heat developable light-sensitive material on the conveying path.

DETAILED DESCRIPTION OF THE INVENTION

In the water-supplying step for use in the present invention, any device may be used as long as it can jet a water droplet having a volume of not more than 0.01 $mm^3$.

First, the function of the water-coating device for use in the present invention is illustrated below.

A plurality of nozzle holes for jetting water reserved in a tank are arranged on a nozzle mounted on the tank, and an actuator displaces the nozzle toward a heat developable light-sensitive material moving on a conveying path.

Accordingly, with this displacement of the nozzle, water is ejected through each of the plurality of nozzle holes to adhere to the heat developable light-sensitive material.

Here, the plurality of nozzle holes for jetting water are linearly arranged at definite intervals along a direction intersecting the conveying direction of the heat developable light-sensitive material, so that water is supplied onto wide range of the conveyed heat developable light-sensitive material by one displacement with the actuator.

The particle size of the jetted water is determined by the dimension of the nozzle holes. Further, no mixing of gas and liquid occurs, which results in no fluctuation of the particle size. Furthermore, the linear arrangement of the nozzle holes at definite intervals eliminates fluctuation in impact positions of water. Hence, the uniformity of water supplied on the surface to be coated is not deteriorated by these kinds of fluctuations.

Further, because the plurality of nozzle holes are linearly arranged at definite intervals along the direction intersecting the conveying direction of the heat developable light-sensitive material, scanning of the nozzle on a two-dimensional plane becomes unnecessary, making it possible to coat a large area for a short period of time.

Furthermore, the nozzle having the nozzle holes is not brought into contact with the heat developable light-sensitive material. This results in no clogging and no contamination, improvement in durability, and lower requisition of alignment precision.

On the other hand, the nozzle is required only to have the plurality of nozzle holes formed therein, so that the integration technique becomes unnecessary. It becomes therefore possible to produce the coating-device at low cost.

When a plurality of lines of the nozzle holes, each of which linearly arranged at definite intervals along the direction intersecting the conveying direction of the heat developable light-sensitive material, are disposed in the staggered arrangement on the nozzle, a larger number of liquid droplets are adhered to the heat developable light-sensitive material at a fewer displacement cycles, and the closest packing coating or multiple coating can be attained, resulting in the increased supplying amount and improved uniformity.

Figure 1:
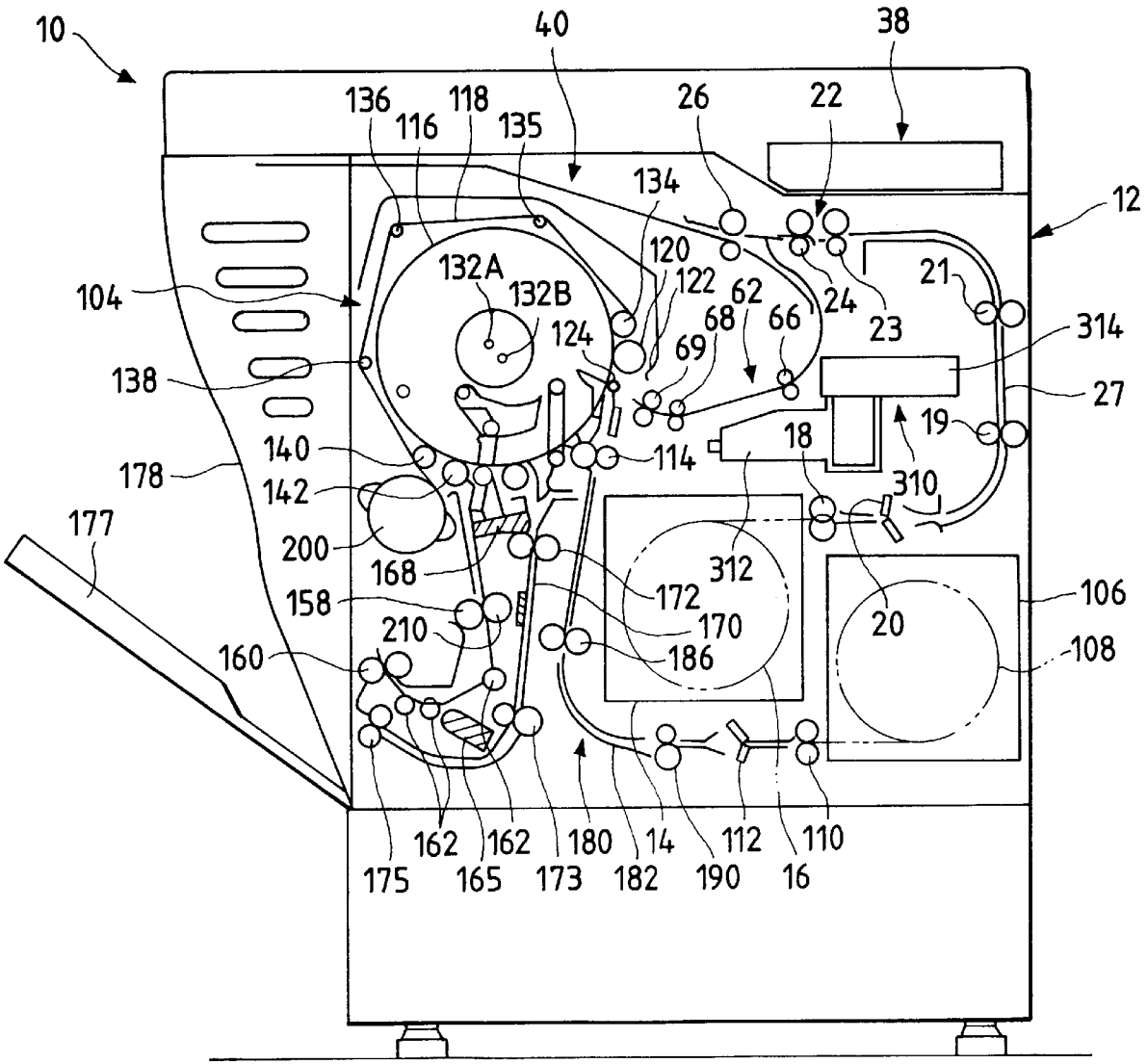
FIG. 1 is a schematic general view illustrating an image recording apparatus according to a first embodiment of the present invention.
Figure 2:
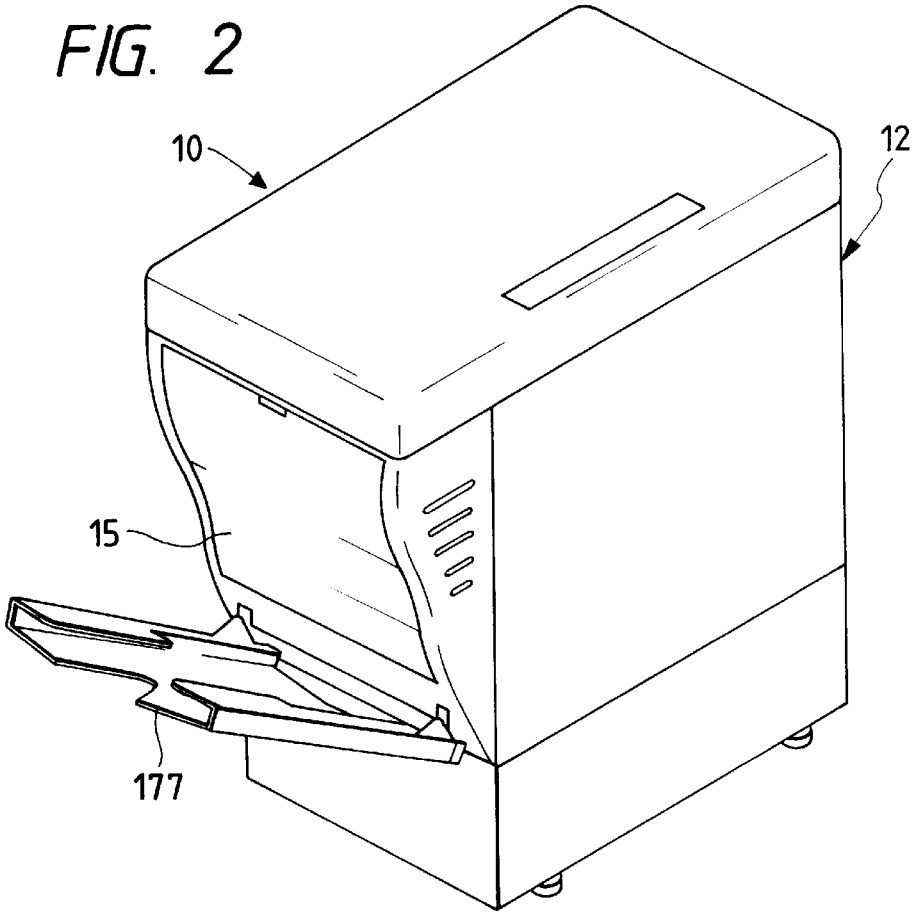
FIG. 2 is a perspective view illustrating the image recording apparatus according to the first embodiment of the present invention.

FIG. 1 is a schematic general view illustrating an image recording apparatus 10 of a first embodiment of the present invention, and FIG. 2 is a perspective view thereof.

Referring to FIGS. 1 and 2, a light-sensitive material magazine 14 is disposed in a frame 12 of the image recording apparatus 10, and a heat developable light-sensitive material 16 having a width, for example, of 224 mm is wound up in a roll form and housed in the light-sensitive material magazine 14. The heat developable light-sensitive material 16 comprises a support having thereon a light-sensitive silver halide, a binder and a dye-donating compound, and wound up so that a light-sensitive (exposure) surface thereof faces the lower portion of the apparatus.

Nip rollers 18 and a cutter 20 are arranged in the vicinity of a light-sensitive material take-off of the light-sensitive material magazine 14, whereby a predetermined length of the light-sensitive material 16 can be drawn out of the light-sensitive material magazine 14, followed by cutting. The cutter 20 is, for example, a rotary type cutter comprising a stationary cutting edge and a moving cutting edge, and the moving cutting edge is moved up and down by a rotary cam to bring it into engagement with the stationary cutting edge, thereby enable to cut the light-sensitive material 16. After operation of the cutter 20, the nip rollers 18 are reversely rotated to rewind the light-sensitive material 16 until a leading edge of the light-sensitive material is slightly nipped between the nip rollers 18.

A plurality of conveying rollers 19, 21, 23, 24 and 26 and a guide plate 27 are disposed downstream from the cutter 20, and convey the light-sensitive material 16 cut to the predetermined length to an exposure section 22.

The exposure section 22 is positioned between the upstream conveying rollers 23 and the downstream conveying rollers 24 which are each a pair of conveying rollers, and has an exposure point between the conveying rollers 23 and 24. The light-sensitive material 16 passes over the exposure point, nipped between the conveying rollers 23 and the conveying rollers 24, respectively. The conveying speed of the light-sensitive material 16 (the speed of the light-sensitive material 16 passing through the exposure section 22) by the conveying rollers 23 and 24 is, for example, 12 mm/second.

Further, an exposing device 38 is mounted just above the exposure section 22. Three kinds of LDs, a lens unit, a polygon mirror and a mirror unit (all of which are not shown in the drawing) are disposed in the exposing device 38.

Furthermore, a switchback section 40 is provided at the side of the exposure section 22, and a coating device 310 for a solvent for image formation is installed under the exposure section 22. In this embodiment, water is used as the solvent. The light-sensitive material 16 which has moved upward through the side of the light-sensitive material magazine 14 and exposed at the exposure section 22 is once fed to the switchback section 40, and then fed to a water-coating section 62, accompanied with the coating device 310, by reverse rotation of the conveying rollers 26 through a conveying path provided under the exposure section 22.

Figure 3:
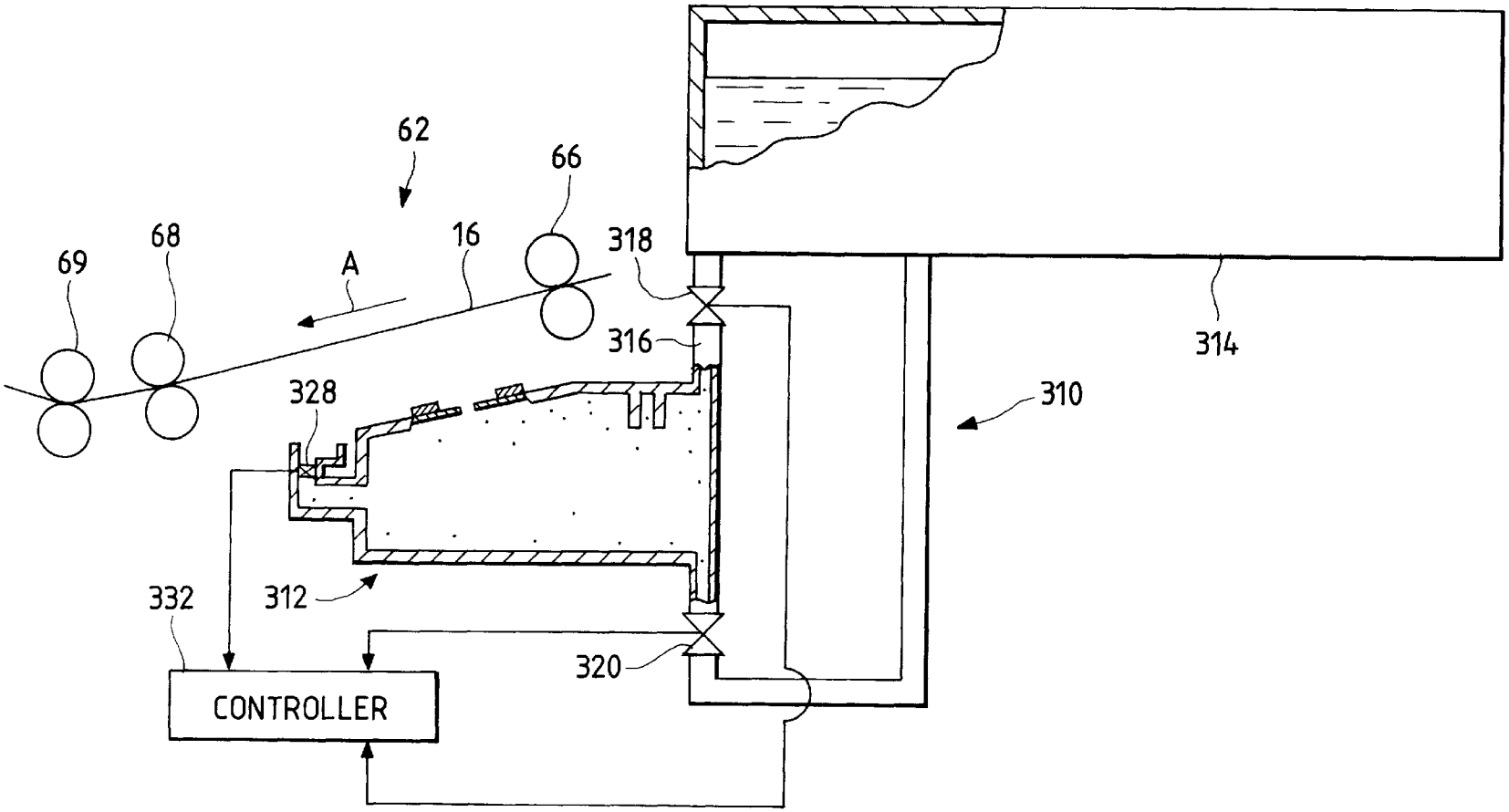
FIG. 3 is a schematic general view illustrating a solvent-coating device for image formation according to the first embodiment of the present invention.

On the other hand, as shown in FIG. 3, a jet tank 312 is arranged in a position facing to a conveying path A of the light-sensitive material 16 in the water-coating section 62. A pair of conveying rollers 66 are arranged upstream with respect to the jet tank 312 in a conveying direction of the light-sensitive material 16, and two pairs of conveying rollers 68 and 69 are arranged downstream with respect to the jet tank 312 in the conveying direction of the light-sensitive material 16.

Further, a pool tank 314 filled with water, which is used as the solvent for image formation, is arranged above the jet tank 312, and a pipe 316 connected to the jet tank 312 midway is connected to a bottom of the pool tank 314 in the loop form.

The pipe 316 is provided with an upper valve 318 and a lower valve 320 over and under the jet tank 312, respectively, and a flow path in the pipe 316 can be opened and closed with the pair of valves 318 and 320. Water fed from the pool tank 314 through the pipe 316 by gravity is reserved in the jet tank 312.

Figure 4:
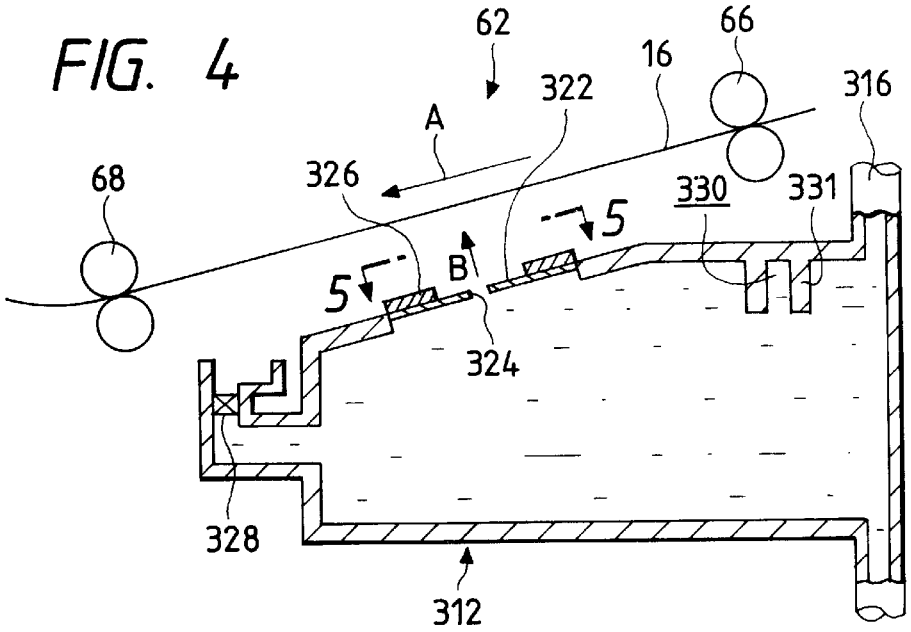
FIG. 4 is an enlarged partial cross sectional view of a jet tank according to the first embodiment of the present invention.

Further, as shown in FIG. 4 which is an enlarged view of the jet tank 312, a part of an upper side wall of the jet tank 312 facing to the conveying path A of the light-sensitive material 16 is fitted with a head plate 322 which is a nozzle formed of a thin elastically deformable plate.

Figure 5:
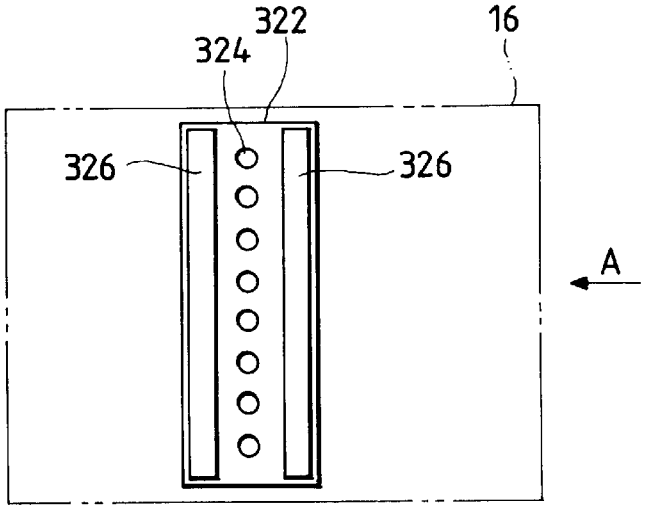
FIG. 5 is a plan view taken along line 5—5 in the direction indicated by the arrows numbered as 5 in FIG. 4.

As shown in FIG. 5, a plurality of nozzle holes 324 (for example, having a diameter of several tens $\mu$m) are linearly arranged at definite intervals along a direction intersecting the conveying direction of the light-sensitive material 16. Water contained in the jet tank 312 can therefore be discharged through each of the nozzle holes 324.

Further, monomorph or bimorph piezoelectric elements 326 acting as an actuator are adhered to the head plate 322, to which an electric source not shown in the drawing is connected.

Figure 6:
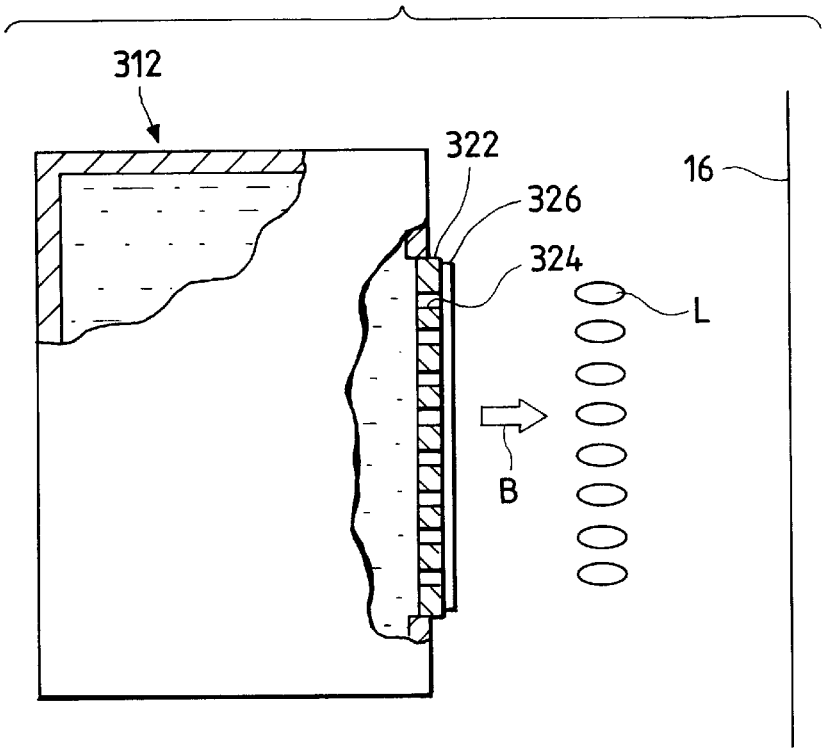
FIG. 6 is a schematic view illustrating the jet tank according to the first embodiment of the present invention.

Accordingly, when the piezoelectric elements 326 are electrified from the electric source, they bend the head plate 322 to displace a central portion of the head plate 322 toward the light-sensitive material 16 on the conveying path A (namely, displacement along the arrow B shown in FIG. 4, that is the direction of the normal with respect to the head plate 322). Accompanied with the displacement of the head plate 322 toward the light-sensitive material 16, water droplets L are ejected through the plurality of nozzle holes 324, as shown in FIG. 6 indicating a schematic view of the jet tank 312.

On the other hand, as shown in FIGS. 3 and 4, this jet tank 312 is provided with a tank valve 328 at a position somewhat below and downstream side of the nozzle holes 324, and an inside of the jet tank 312 can be communicated with and disconnected from the air by the opening and closing movements of the tank valve 328. The upper valve 318, the lower valve 320 and the tank valve 328 are each connected to a controller 332 as shown in FIG. 3, and the opening and closing movements of each of the valves 318, 320 and 328 are controlled with the controller 332.

In addition, an air reservoir 330 surrounded with a cylindrical rib 331 is formed on an inner wall surface on an upper side in the jet tank 312 as shown in FIG. 4.

On the other hand, as shown in FIG. 1, an image receiving material magazine 106 is disposed at the side of the light-sensitive material magazine 14 in the frame 12, and an image receiving material 108 is wound up in a roll form and housed therein. An image forming surface of the image receiving material 108 is coated with a dye-fixing material having a mordant, and the image receiving material 108 is wound up so that the image forming surface thereof faces upward of the apparatus.

Nip rollers 110 are disposed in the vicinity of an image receiving material take-off of the image receiving material magazine 106. The image receiving material 108 can be drawn out of the image receiving material magazine 106, and their nip can be released.

A cutter 112 is arranged at the side of the nip rollers 110. Similarly to the above-described cutter 20 for the light-sensitive material, the cutter 112 is, for example, a rotary type cutter comprising a stationary cutting edge and a moving cutting edge, and the moving cutting edge is moved up and down by a rotary cam to bring it into engagement with the stationary cutting edge, thereby cutting the image receiving material 108 which is drawn out of the image receiving material magazine 106 to a length shorter than that of the light-sensitive material 16.

An inlet of an image receiving material conveying section 180 positioned at the side of the light-sensitive material magazine 14 is installed at the side of the cutter 112.

Conveying rollers 186, 190 and 114 and a guide plate 182 are disposed in the image receiving material conveying section 180, whereby the image receiving material 108 cut to the predetermined length can be conveyed to a heat development transfer section 104.

Figure 7:
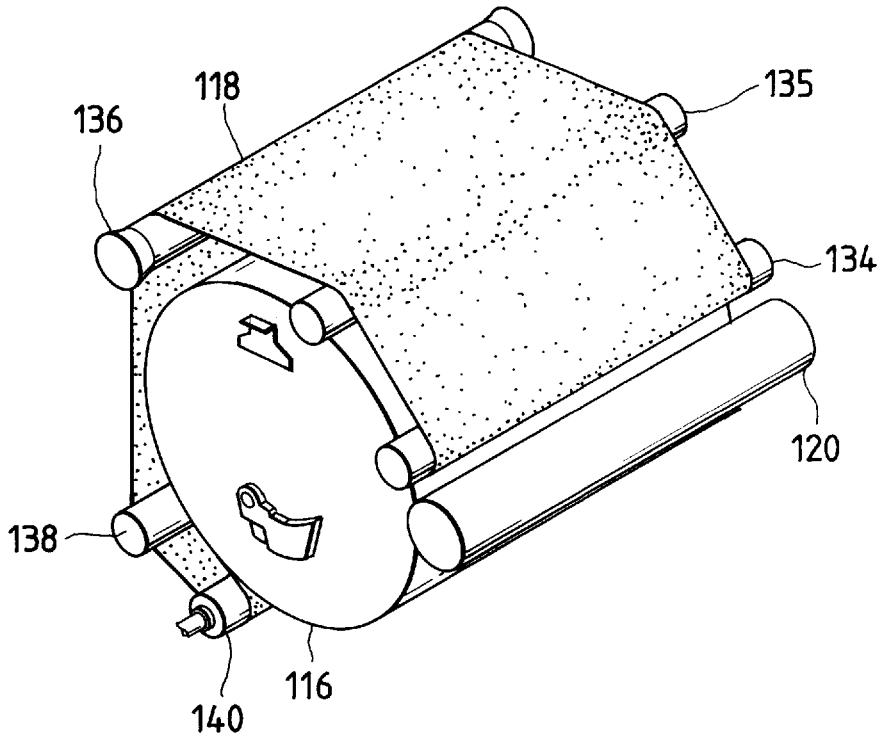
FIG. 7 is a perspective view illustrating a heating drum of a heat development transfer section.

As shown in FIG. 7, the heat development transfer section 104 is made up of a heating drum 116 and an endless pressure welding belt 118, and a laminating roller 120 is disposed on the periphery of the heating drum 116 on the side of the water-coating section 62.

A guide plate 122 is disposed, as shown in FIG. 1, at a position on a conveying path of the light-sensitive material 16 between the laminating roller 120 and the conveying rollers 69 of the water-coating section 62 and facing the back surface (the opposite side to the image forming surface) of the light-sensitive material 16 conveyed from the conveying rollers 69, and guides the light-sensitive material 16 to the laminating roller 120.

The laminating roller 120 is connected to a drum motor 200 through a driving system not shown in the drawing, and the driving force of the drum motor 200 is transmitted to the laminating roller 120 to rotate it.

The light-sensitive material 16 to be conveyed to the heat development transfer section 104 is fed between the laminating roller 120 and the heating drum 116. The image receiving material 108 is conveyed in synchronism with the conveyance of the light-sensitive material 16, and fed between the laminating roller 120 and the heating drum 116 with the light-sensitive material 16 preceding the image receiving material 108 by a predetermined length (20 mm in this embodiment), thereby superposing them on each other. In this case, the image receiving material 108 is sized smaller in both width and length than the light-sensitive material 16. They are therefore overlapped in the state that the peripheral portion of the light-sensitive material 16 protrudes from that of the image receiving material 108 at all the four sides.

A pair of halogen lamps 132A and 132B are arranged in the inside of the heating drum 116. The halogen lamps 132A and 132B have, for example, outputs of 400 W and 450 W, respectively, and can elevate the surface temperature of the heating drum 116 to heat it to a predetermined temperature. In this case, the two halogen lamps 132A and 132B are both used at the start of the heating, and the one halogen lamp 132A is only used in the subsequent normal operation.

The endless pressure welding belt 118 is wrapped around five wrapping rollers 134, 135, 136, 138 and 140, and the peripheral side thereof between the wrapping rollers 134 and 140 is pressed on the peripheral surface of the heating drum 116.

On the other hand, the wrapping roller 140 is connected to the drum motor 200 through a driving system not shown in the drawing, and the driving force of the drum motor 200 is transmitted to the wrapping roller 140 to rotate it. The rotation of this wrapping roller 140 causes the endless pressure welding belt 118 wrapped around the wrapping roller 140 to rotate, whereby the force of rotation of the endless pressure welding belt 118 is transmitted to the heating drum 116 by the frictional force with the heating drum to drive the heating drum 116 for rotation.

The drum motor 200 drives a plurality of driving members, that is, the wrapping roller 140, the laminating roller 120, the conveying rollers 68 and 69, and a bending guide roller 142, light-sensitive material discharge rollers 158 and 160 and image receiving material discharge rollers 172, 173 and 175 described below.

The light-sensitive material 16 and the image receiving material 108 overlapped by use of the laminating roller 120 are conveyed over about two-third (between the wrapping rollers 134 and 140) the circumference of the heating drum 116 while being overlapped each other and nipped between the heating drum 116 and the endless pressure welding belt 118. Further, when the light-sensitive material 16 and the image receiving material 108 overlapped are completely included between the heating drum 116 and the endless pressure welding belt 118, the rotation of the heating drum 116 is once stopped (for example, for from 5 to 15 seconds), and the light-sensitive material 16 and the image receiving material 108 nipped are heated. When heated in conveying and in stopping, the light-sensitive material 16 releases a mobile dye, which is concurrently transferred to a dye-fixing layer of the image receiving material 108, to thereby form an image.

The bending guide roller 142 is disposed on the lower portion of the heating drum 116, downstream with respect to the endless pressure welding belt 118 in a direction to supply the materials. The bending guide roller 142 is a rubber roller made of silicone rubber, and is rotated by transmission of the driving force of the drum motor 200. The bending guide roller 142 is pressed on the periphery of the heating drum 116 at a predetermined pressure, and the light-sensitive material 16 and the image receiving material 108 conveyed with the heating drum 116 and the endless pressure welding belt 118 can be further conveyed while being nipped between the heating drum 116 and the bending guide roller 142.

Separating claws (not shown in the drawing) are arranged on the lower portion of the heating drum 116, downstream with respect to the bending guide roller 142 in a direction to supply the materials, and come into engagement with only a leading edge of the light-sensitive material 16, of the light-sensitive material 16 and the image receiving material 108 conveyed with being nipped between the heating drum 116 and the endless pressure welding belt 118, to thereby enable to separate the leading edge from the periphery of heating drum 116.

The light-sensitive material discharge rollers 158 and 160 and a plurality of guide rollers 162 are arranged under the bending guide roller 142 and the separating claws, whereby the light-sensitive material 16 moved downward while being wrapped around the bending guide roller 142 can be further conveyed to accumulate it in a waste light-sensitive material receiving case 178. The light-sensitive material discharge rollers 158 and 160 are driven for rotation by transmission of the driving force of the drum motor 200 for driving the heat development transfer section 104 as described above.

In the vicinity of the guide rollers 162, a drying fun 165 is disposed, to thereby accelerate the drying of the light-sensitive material 16.

Referring to FIG. 1, the image receiving material discharge rollers 172, 173 and 175, as well as an image receiving material guide 170, are arranged under the heating drum 116 and on the right side of the bending guide roller 142, whereby the image receiving material 108 separated from the heating drum 116 by separating claws (not shown in the drawing), which are different from the above-described ones, can be guided and conveyed.

A drum fun 168 is installed under the heating drum 116. Accordingly, the image receiving material 108 moving along the heating drum 116 is not only dried by heat of the heating drum 116, but also accelerated in drying with the drum fun 168. The image receiving material guide 170 is provided with a ceramic heater 210, to thereby further accelerate the drying of the image receiving material 108 conveyed.

The image receiving material 108 separated from the periphery of the heating drum with the separating claws while being accelerated the drying thereof with the drum fun 168 is conveyed by the image receiving material guide 170 and the image receiving material discharge rollers 172, 173 and 175, and discharged to a tray 177.

The operation of this embodiment will be described below.

In the image recording apparatus 10 having the constitution as described above, the light-sensitive material magazine 14 is set, and then the nip rollers 18 are operated to draw out the light-sensitive material 16 with the nip rollers 18. When a predetermined length of the light-sensitive material 16 is drawn out, the cutter 20 is actuated to cut the light-sensitive material 16 to the predetermined length.

After actuation of the cutter 20, the light-sensitive material 16 cut to the predetermined length is conveyed with the conveying rollers 19, 21, 23, 24 and 26, turned over, and conveyed to the exposure section 22 with the light-sensitive (exposure) surface facing upward. At the time when the light-sensitive material 16 is nipped between the conveying rollers 23, the drive of the conveying rollers 23 is once stopped, and the light-sensitive material 16 is in the stand-by condition just before the exposure section 22.

Then, the drive of the conveying rollers 23 and 24 is restarted, and the light-sensitive material 16 passes through the exposure section 22 at a predetermined speed. The exposing device 38 is operated at the same time that the light-sensitive material 16 is conveyed (passes through the exposure section 22) to scanning-expose an image to the light-sensitive material 16 positioned in the exposure section 22.

When the exposure is terminated, the light-sensitive material 16 exposed is conveyed to the water-coating section 62. In the water-coating section 62, the light-sensitive material 16 conveyed is fed toward the jet tank 312 by the drive of the conveying rollers 66, and further conveyed while being nipped between the conveying rollers 68 and the conveying rollers 69, respectively.

Then, water is applied to the light-sensitive material 16 conveyed along the conveying path A by jetting from the jet tank 312. The operation and function here are described below.

First, the upper valve 318 and the lower valve 320 are opened and the tank valve 328 is closed by the controller 332. Water is fed from the pool tank 314 to the jet tank 312 through the pipe 316 by gravity, and reserved in the jet tank 312.

Accordingly, electrifying from the electric source deforms the piezoelectric elements 326 to displace the head plate 322 of the jet tank 312. In accordance with the displacement, water is ejected in the direction of the arrow B through each of the plurality of nozzle holes 324 to adhere to the light-sensitive material 16 during conveyance. Then, water is applied to the whole surface of the light-sensitive material 16 by continuously jetting water through the nozzle holes 324.

In this operation, as shown in FIG. 5, the plurality of nozzle holes 324 for jetting water are linearly arranged at definite intervals along a direction intersecting the conveying direction of the light-sensitive material 16, so that water is supplied onto wide range of the conveyed heat developable light-sensitive material by one displacement with the actuator.

The particle size of jetted water is determined by the dimension of the nozzle holes 324. Further, no fluctuation in the particle size is caused because of no mixing of gas and liquid, and no fluctuation in impact positions of water is caused because of the linear arrangement of the nozzle holes 324 at definite intervals. Hence, the uniformity of water supplied on the surface of the light-sensitive material 16, the coated surface, is not deteriorated by these fluctuations.

Further, the plurality of nozzle holes 324 are linearly arranged at definite intervals along the direction intersecting the conveying direction of the light-sensitive material 16, so that it becomes unnecessary to scan the head plate 322 on a two-dimensional plane. This enables to coat a large area for a short period of time. Furthermore, the head plate 322 having the nozzle holes 324 is not brought into contact with the light-sensitive material 16, resulting in no clogging and no contamination, improvement in durability of the coating device 310, and lower requisition of alignment precision.

On the other hand, the head plate 322 is required only to form the plurality of nozzle holes 324, so that the integration technique becomes unnecessary. It becomes therefore possible to produce the coating device 310 at low cost.

When water is jetted through the nozzle holes 324, the upper valve 318 and the lower valve 320 are closed and the tank valve 328 is opened by the controller 332, whereby the pressure in the vicinity of the nozzle holes 324 in the jet tank 312 becomes negative, which can prevent liquid leaks from the nozzle holes 324.

Thereafter, the light-sensitive material 16 coated with water which is the solvent for image formation in the water-coating section 62 is fed to the heat development transfer section 104 with the conveying rollers 68 and 69.

On the other hand, accompanied with the start of scanning exposure to the light-sensitive material 16, the image receiving material 108 is also drawn out of the image receiving material magazine 106 with the nip rollers 110, and conveyed. When a predetermined length of the image receiving material 108 is drawn out, the cutter 112 is actuated to cut the image receiving material 108 to the predetermined length.

After operation of the cutter 112, the image receiving material 108 cut is conveyed with the conveying rollers 190, 186 and 114 while being guided with the guide plate 182 of the image receiving material conveying section 180. When a leading edge of the image receiving material 108 is nipped between the conveying rollers 114, the image receiving material 108 is in the stand-by condition just before the heat development transfer section 104.

In the heat development transfer section 104, when it is detected that the light-sensitive material 16 is fed between the periphery of the heating drum 116 and the laminating roller 120 by the conveying rollers 68 and 69, the conveyance of the image receiving material 108 is resumed to feed it to the laminating roller 120, and the heating drum 116 is concurrently operated.

Then, the light-sensitive material 16 and the image receiving material 108 are nipped and conveyed. On arriving at the lower portion of the heating drum 116, the separating claws are actuated to come into engagement with the leading edge of the light-sensitive material 16 conveyed preceding the image receiving material 108 by a predetermined length, to thereby separate the leading edge of the light-sensitive material 16 from the periphery of the heating drum 116, and the light-sensitive material 16 is wrapped around the bending guide roller 142. The light-sensitive material 16 wrapped around the bending guide roller 142 is further conveyed with the light-sensitive material discharge rollers 158 and 160 while being guided with the guide rollers 162. In this case, the light-sensitive material 16 is dried with the drying fun 165, and accumulated in the waste light-sensitive material receiving case 178.

On the other hand, the image receiving material 108 separated from the light-sensitive material 16 is conveyed by the image receiving material discharge rollers 172, 173 and 175 while being guided with the image receiving material guide 170. The image receiving material 108 is discharged to the tray 177 while being dried with the drum fun 168 and the ceramic heater 210.

When a plurality of sheets of image recordings are performed, the above-described process is continuously repeated.

As described above, the image receiving material 108 wound around the heating drum 116 and subjected to the heat development transfer processing to form (record) the predetermined image is separated from the heating drum 116, accelerated in drying by heating means such as the drum fun 168 and the ceramic heater 210, and further nipped and conveyed by the plurality of image receiving material discharge rollers 172, 173 and 175 to take it out of the apparatus.

Then, modified embodiments of the coating device 310 of the image recording apparatus 10 according to the first embodiment of the present invention are illustrated below with reference to FIGS. 8 to 11.

Figure 8:
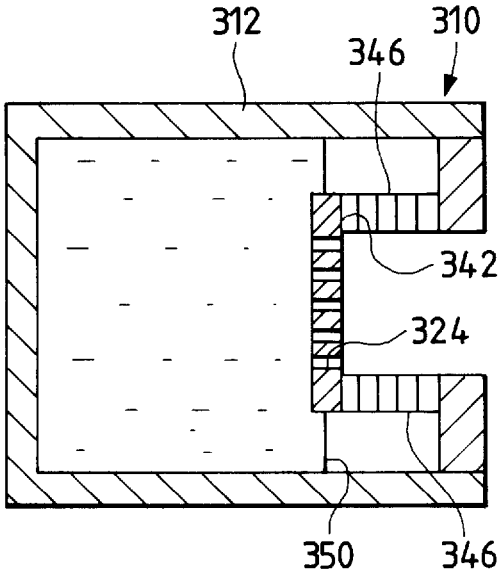
FIG. 8 is a schematic view illustrating a first modified embodiment of the jet tank according to the first embodiment of the present invention.

As shown in FIG. 8, a first modified embodiment of the coating device 310 has such a structure that a head plate 342, i.e., nozzle, is formed of a high rigid plate, a sealing member 350 for preventing water leakage is arranged on the periphery of the head plate 342, and the head plate 342 is connected to a wall face of a jet tank 312 through laminated piezoelectric elements 346.

Figure 9:
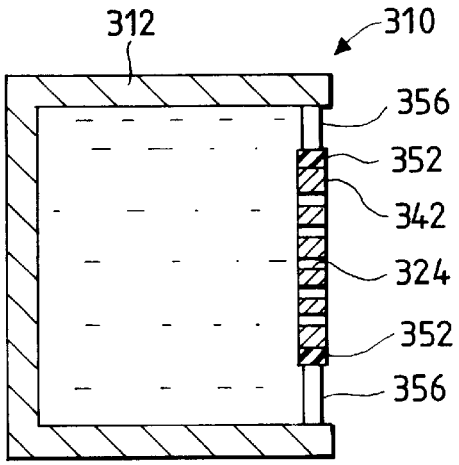
FIG. 9 is a schematic view illustrating a second modified embodiment of the jet tank according to the first embodiment of the present invention.

As shown in FIG. 9, a second modified embodiment of the coating device 310 has such a structure that a head plate 342, i.e., a nozzle, is formed of a high rigid plate in the same way as above, and the head plate 342 is connected to a wall face of a jet tank 312 by monolayer or two-layer piezoelectric elements 356 through buffer materials 352 such as packing materials.

Figure 10:
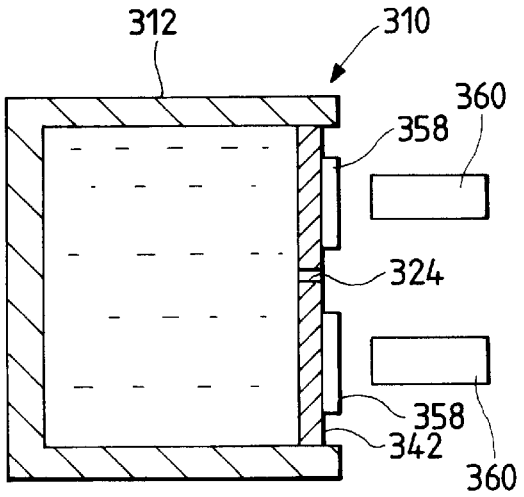
FIG. 10 is a schematic view illustrating a third modified embodiment of the jet tank according to the first embodiment of the present invention.

As shown in FIG. 10, a third modified embodiment of the coating device 310 has such a structure that a magnetizable steel plate 358 is affixed to a head plate 342, i.e., a nozzle, and electromagnets 360 are disposed opposite to the steel plate 358. In this modified embodiment, the head plate itself may be formed of the steel plate instead of affixture of the steel plate 358.

Such a structure as described above makes it possible to displace the head plate 342 by attraction or repulsion caused by the electromagnets 360. FIG. 10 is a cross sectional view of the jet tank 312 seen from the upside thereof, different from other modified embodiments.

Figure 11:
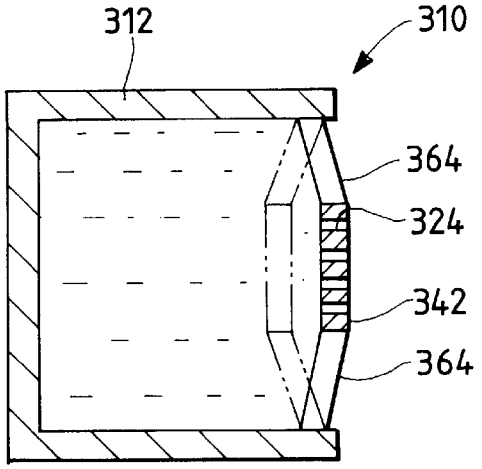
FIG. 11 is a schematic view illustrating a fourth modified embodiment of the jet tank according to the first embodiment of the present invention.

As shown in FIG. 11, a fourth embodiment of the coating device 310 has such a structure that a head plate 342, i.e., a nozzle, is formed of a high rigid plate, and the head plate 342 is deformably connected to a wall face of a jet tank 312 through high rigid movable plates 364. The head plate 342 and the movable plate 364, and the wall face of the jet tank 312 and the movable plate 364 are each joined in the hinge form. Further, monomorph, bimorph or laminated piezoelectric elements, or the electromagnets 360 for use in the third modified embodiment are employed as an actuator. In FIG. 11, the position indicated by the solid line and the position indicated by the two-dot chain line are each stable positions, and the head plate 342 is displaced between these stable positions with the actuator.

Taking the structure of each of the modified embodiments as described above enables to displace the head plate 342 in the same manner as in the first embodiment described above. Water is therefore ejected through each of the plural nozzle holes 324 of each modified embodiment to adhere to the light-sensitive material 16 similarly to the function of the first embodiment described above.

Then, a head plate of a coating device 310 of an image recording apparatus 10 according to a second embodiment of the present invention are described below with reference to FIGS. 12(A) to 12(C). The same reference numerals as used in reference to the first embodiment are used to designate corresponding parts in FIGS. 12(A) to 12(C), and common descriptions are omitted.

Figure 12A:
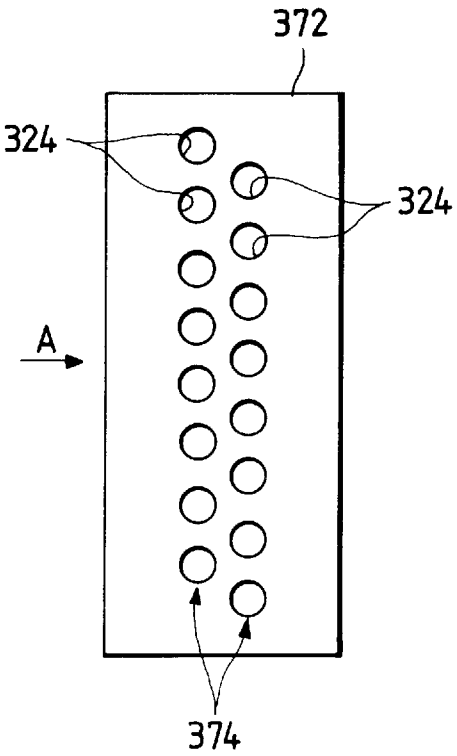
FIGS. 12(*a*) to 12(*c*) are front views each illustrating a head plate of a solvent-coating device for image formation according to a second embodiment of the present invention.

As shown in FIG. 12(A), on a head plate 372 which is a nozzle of the coating device 310 according to this embodiment, two lines 374 of plural nozzle holes 324 for jetting water linearly arranged at definite intervals along the direction intersecting the conveying direction A of a light-sensitive material 16 are disposed in the staggered arrangement.

The function of this embodiment is described below.

This embodiment also functions similarly to the first embodiment. However, because the plurality of lines 374 of the plural nozzle holes 324 linearly arranged at definite intervals along the direction intersecting the conveying direction of the light-sensitive material 16 are disposed on the head plate 372 in the staggered arrangement, a larger number of liquid droplets are adhered to the light-sensitive material 16 at a fewer displacement cycles, and the closest packing coating or a multiple coating is possible, to thereby increase a coating amount and to improve uniformity.

Then, modified embodiments of the coating device 310 according to the second embodiment of the present invention are described below with reference to FIGS. 12(B) and 12(C).

Figure 12B:
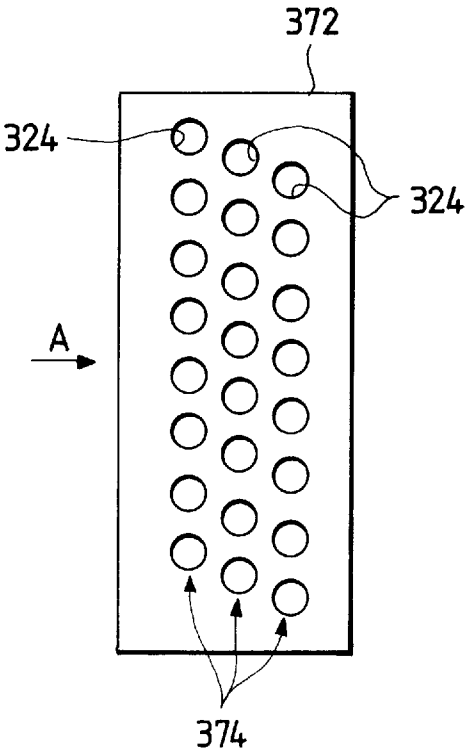

As shown in FIG. 12(B), on a head plate 372 which is a nozzle of the coating device 310 according to a first modified embodiment, three lines 374 of plural nozzle holes 324 for jetting water linearly arranged at definite intervals along the direction intersecting the conveying direction of the light-sensitive material 16 are disposed in the staggered arrangement.

Figure 12C:
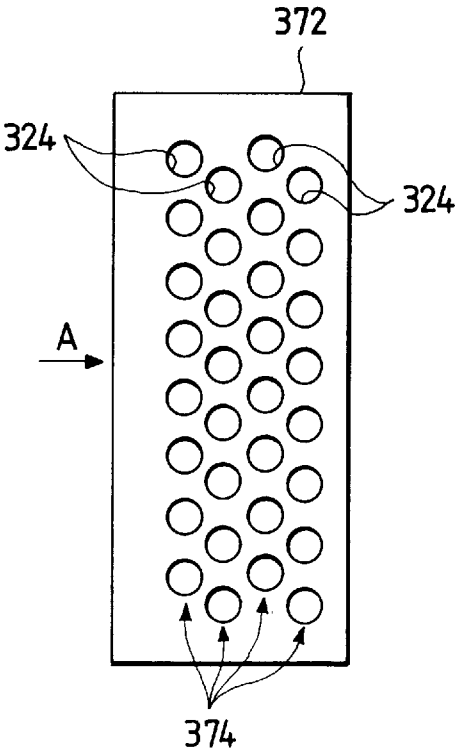

As shown in FIG. 12(C), on a head plate 372 which is a nozzle of the coating device 310 according to a second modified embodiment, the pattern is continuously repeated in which two lines 374 of plural nozzle holes 324 for jetting water linearly arranged at definite intervals along the direction intersecting the conveying direction of the light-sensitive material 16 are disposed in the staggered arrangement.

According to such structures of the first and second modified embodiments, the displacement of the head plate 372 causes water to eject through each of the nozzle holes 324 constituting the plurality of nozzle hole lines 274 in the same manner as described above. This enables to effect the closest packing coating or a multiple coating, to thereby increase the coating amount and to improve uniformity.

In the above described embodiments, the light-sensitive material 16 and the image receiving material 108 are used as the image recording material, and conveyed so that the light-sensitive material 16 is located outside the image receiving material 108, after exposure, but not limited thereto. The present invention is also applicable when the image recording material is conveyed so that the light-sensitive material 16 is located inside the image receiving material 108. Further, the present invention is applicable not only to these materials, but also to other sheet-like or roll-like image recording materials.

As described above, the water-coating device for use in the present invention has the excellent effect in that the uniformity of water on the coated surface can be improved.

The volume of water droplets for use in the present invention means an average volume per droplet jetted through each nozzles.

In the present invention, the volume of the water droplet is not more than 0.01 $mm^3$, preferably not more than 0.005 $mm^3$ and more preferably not more than 0.001 $mm^3$. Although there is no limitation on the lower limit, it is about $10^{-8}$ $mm^3$. If the volume of water droplets exceeds 0.01 $mm^3$, water can not be applied uniformly, resulting in worsened density unevenness.

The volume of the water droplet for use in the present invention can be adjusted by appropriately selecting the size of the nozzle holes 324, and the displacement amount and the frequency of the head plate 322 shown in FIG. 6.

In the present invention, the volume of the water droplet can be measured by jetting water droplets through nozzles, taking a photograph of the state of one water droplet with a high-speed camera (about 200 or more frames per second) and observing the shape and the size of the water droplets.

The jetting speed of the water droplets in the present invention may be any, but is preferably from 0.1 m/second to 50 m/second.

The above-described jet-water-coating system of the present invention may be either a system in which only a necessary amount of water is supplied, or a system in which water exceeding a necessary amount is supplied and thereafter removed, for example, squeezed by squeeze rollers.

The above-described necessary amount of water means an amount of water necessary for transferring a diffusive dye image to a dye-fixing element by heat development, and is determined depending on the gelatin coating amount of the heat developable color light-sensitive material and the gelatin coating amount of the dye-fixing element. However, in the present invention, the necessary amount of water is generally within the range of from 1 $g/m^2$ to 40 $g/m^2$, preferably within the range of from 3 $g/m^2$ to 30 $g/m^2$, and more preferably within the range of from 6 $g/m^2$ to 25 $g/M^2$.

The contact angle for use in the present invention is defined as a measure of wettability, for example, in *Kohbunshi Zairyo No Shikenho To Hyoka* (Test Methods and Evaluation of Polymer Materials), page 325, edited by Kohbunshi Gakkai. That is, a smaller contact angle indicates that a light-sensitive material is easily wettable, and a greater contact angle indicates that a light-sensitive material is difficult to be wet.

In the present invention, the contact angle can be measured by jetting water droplets having a volume of not more than 0.01 $mm^3$, and taking a photograph of some one water droplet 0.5 second after the impact on a light-sensitive material with a high-speed camera (about 200 or more frames per second).

In the present invention, the contact angle is preferably not more than 40 degrees, and more preferably not more than 30 degrees.

The contact angle can be adjusted by various formulation factors such as various surfactants, binders and hardeners described below. In particular, they are preferably added to the uppermost layer. Of these, the use of the surfactants is particularly effective, and specific examples thereof are described in JP-A-62-173463 and JP-A-62-183457. Further, the use of fluorine surfactants is particularly preferred, and specific examples thereof include compounds described in JP-B-57-9053 (the term "JP-B" as used herein means an "examined Japanese patent publication"), columns 8 to 17, JP-A-61-20944 and JP-A-62-135826, perfluoroalkylaminosulfonates and perfluoroalkylaminocarboxylates. These surfactants may be used alone or in combination. When a fluorine surfactant is used, the addition amount is preferably from 1 mg/m$^2$ to 100 mg/m$^2$, and particularly preferably from 1 mg/m$^2$ to 10 mg/m$^2$.

The contact angle in the present invention can also be adjusted by controlling the addition amount of these compounds or the addition amount ratio of two or more compounds used in combination.

Besides the formulation factors, the contact angle can also be adjusted by the addition of various surfactants or other additives to the water to be jetted.

A light-sensitive element comprising an image forming layer and the dye-fixing element comprising a dye-fixing layer for use in the heat developable color light-sensitive material of the present invention are described in detail below.

The dye-fixing element may be formed on either a support different from that on which the light-sensitive element is formed, or a support on which the light-sensitive element is formed. For the mutual relationship of the light-sensitive element with the dye-fixing element, the support or a white background reflection layer, the relationship described in U.S. Pat. No. 4,500,626 at column 57 can also be applied to the present invention.

In the present invention, the dye-fixing layer is preferably formed on a support different from that for the light-sensitive material. Further, in the present invention, an embodiment is preferred in which water is supplied onto the light-sensitive material.

Mordants known in the field of photography can be used in the dye-fixing layer. Examples thereof include mordants described in U.S. Pat. No. 4,500,626, columns 58 and 59, JP-A-61-88256, pages 32 to 41, JP-A-62-244043 and JP-A-62-244036.

The light-sensitive element for use in the present invention basically comprising a support having thereon a light-sensitive silver halide, a binder and a dye-donating compound (in some case, a reducing agent serves as the dye-donating compound, as described below), and can further contain an organic metal salt oxidizing agent, if necessary.

In many cases, these components are added to the same layer. However, they can be separately added to different layers, as long as they are in a state under which they can react. For example, a colored dye-donating compound prevents a reduction in sensitivity, when allowed to exist in a layer under the silver halide emulsion. The reducing agent is preferably contained in the light-sensitive element. However, they may be supplied from the outside, for example, by diffusion from the dye-fixing element described below.

In order to obtain a wide range of colors on the chromaticity diagram using the three primary colors of yellow, magenta and cyan, at least three silver halide emulsion layers each having light sensitivity in different spectrum regions are used in combination. For example, a combination of the three layers of a blue-sensitive layer, a green-sensitive layer and a red-sensitive layer, or a combination of a green-sensitive layer, a red-sensitive layer and an infrared-sensitive layer can be used. The respective light-sensitive layers can be variously provided in order as known in common color photographic materials. Further, each of these respective light-sensitive layers may be divided into two or more layers as needed.

The light-sensitive element can be provided with various supplementary layers such as a protective layer, an undercoat layer, an intermediate layer, an antihalation layers and a back layer.

Silver halides for use in the present invention may be any of silver chloride, silver bromide, silver iodobromide, silver chlorobromide, silver chloroiodide and silver chloroiodobromide.

The silver halide emulsion for use in the present invention may be either a surface latent image type emulsion or an internal latent image type emulsion. The internal latent image type emulsion is used as a direct reversal emulsion in combination with a nucleating agent or a light fogging. Further, they may be a so-called core/shell emulsion in which the inside and the surface of the grain are formed of different phases. Furthermore, the silver halide emulsion may be either a monodisperse emulsion or a polydisperse emulsion. Alternatively, a polydisperse emulsion mixed with a monodisperse emulsion may be used. The grain size is preferably from 0.1 $\mu$m to 2 $\mu$m, and more preferably from 0.2 $\mu$m to 1.5 $\mu$m. The crystal habit of the silver halide grains may be any of a cubic form, an octahedral form, a tetradecahedral form, a tabular form having a high aspect ratio and other forms.

Specifically, any of silver halide emulsions can be used which are described in U.S. Pat. No. 4,500,626, column 50, U.S. Pat. No. 4,628,021, *Research Disclosure* (hereinafter abbreviated as "RD"), No. 17029 (1978) and JP-A-62-253159.

The silver halide emulsion may be used without subjecting it to sensitization, but generally used after subjecting it to chemical sensitization. Generally, a sulfur sensitization, a reduction sensitization, a noble metal sensitization and a selenium sensitization known in the light-sensitive material emulsion field can be used alone or in combination. These chemical sensitizations can be conducted in the presence of a nitrogen-containing heterocyclic compounds, as described in JP-A-62-253159.

The coated amount of the light-sensitive silver halide emulsion for use in the present invention is preferably from 1 mg/m$^2$ to 10 g/m$^2$ in terms of silver.

In the present invention, an organic metal salt can also be used, as an oxidizing agent, in combination with the light-sensitive silver halide. Of the organic metal salts, organic silver salts are particularly preferably used.

Examples of an organic compound which can be used for forming the above-described organic silver salt oxidizing agent include benzotriazole compounds, fatty acids and other compounds described in U.S. Pat. No. 4,500,626, columns 52 and 53. Silver salts of carboxylic acids having an alkynyl group such as silver phenylpropiolate described in JP-A-60-113235 and silver acetylide described in JP-A-61-249044 are also useful. The organic silver salt may be used in combination of two or more thereof.

The organic silver salt described above can be used, in combination with the light-sensitive silver halide, in an amount of from 0.01 mol to 10 mol, preferably from 0.01 mol to 1 mol, per mol of the light-sensitive silver halide. The total coating amount of the organic silver salts and the light-sensitive silver halides is suitably from 10 mg/m$^2$ to 50 g/m$^2$, in terms of silver.

In the present invention, various antifoggants or photographic stabilizers can be used. Examples thereof include azoles and azaindene compounds described in RD 17643 (1978), pages 24 and 25, nitrogen-containing carboxylic acids and phosphoric acid compounds described in JP-A-59-168442, mercapto compounds and metal salts thereof described in JP-A-59-111636 and acetylene compounds described in JP-A-62-87957.

The silver halide for use in the present invention may be spectrally sensitized with a methine dye or the like. The dye for use herein include cyanine dyes, merocyanine dyes, complex cyanine dyes, complex merocyanine dyes, holopolarcyanine dyes, hemicyanine dyes, styryl dyes and hemioxanol dyes.

Specific examples thereof include sensitizing dyes described in U.S. Pat. No. 4,617,257, JP-A-59-180550, JP-A-60-140335 and RD 17029 (1978) pages 12 and 13.

These sensitizing dyes may be used alone or in combination. The combination use of the sensitizing dyes is aimed at, particularly, supersensitization.

The emulsion may contain a dye providing no spectral sensitizing effect itself or a compound which does not substantially absorb visible light, but exhibits a supersensitization effect, in combination with the sensitizing dye. Examples thereof include those described in U.S. Pat. No. 3,615,613 and JP-A-63-23145.

These sensitizing dyes may be added to the emulsion during, before or after chemical ripening, or before or after nucleation of the silver halide grains according to U.S. Pat. Nos. 4,183,756 and 4,225,666. The sensitizing agent is generally added in an amount of from about $10^{-8}$ mol to about $10^{-2}$ mol per mol of silver halide.

As the binder for the layers constituting the light-sensitive element and the dye-fixing element, a hydrophilic binder is preferably used. Examples thereof include binders described in JP-A-62-253159, pages 26 to 28. Specifically, transparent or translucent hydrophilic binders are preferred, and examples thereof include natural compounds such as proteins (for example, gelatin and gelatin derivatives) and polysaccharides (for example, cellulose derivatives, starch, gum arabic, dextran and pullulan), and synthetic polymers such as polyvinyl alcohol, polyvinylpyrrolidone and polyacrylamide. Further, there can also be used high water-absorptive polymers described in JP-A-62-245260, namely homopolymers of vinyl monomers having —COOM or —$SO_3$M (wherein M represents a hydrogen atom or an alkali metal), copolymers of two or more kinds of these vinyl monomers, and copolymers of the vinyl monomer with other monomers (for example, sodium methacrylate, ammonium methacrylate and Sumikagel L-5H manufactured by Sumitomo Chemical Co, Ltd.). These binders can be used in a combination of two or more thereof.

When a system in which a trace amount of water is supplied to conduct heat development is employed, the use of the above-described high water-absorptive polymer makes it possible to rapidly absorb water. Further, the use of the high water-absorptive polymer in the dye-fixing layer or the protective layer thereof can prevent dyes from retransferring from the dye-fixing element to the others after transfer.

In the present invention, the coating amount of the binder is preferably from not more than 20 g/m$^2$, more preferably not more than 10 g/m$^2$, and most preferably not more than 7 g/m$^2$.

For improving film properties such as dimension stabilization, curl prevention, adhesion prevention, film crack prevention and pressure-(de)sensitization prevention, various polymer latexes can be added to the layers (including back layers) constituting the light-sensitive element or the dye-fixing element. Specifically, any of polymer latexes described in JP-A-62-245258, JP-A-62-136648 and JP-A-62-110066 can be used. In particular, the use of polymer latexes having a low glass transition temperature (40° C. or less) in a mordant layer can prevent development of cracks in the mordant layer, whereas the use of polymer latexes having a high glass transition temperature in a back layer can provide a curl prevention effect.

In the present invention, reducing agents known in the field of light-sensitive element can be used. Further, the reducing agents also include reductive dye-donating compounds described below (in this case, they can be used in combination with other reducing agents). Furthermore, precursors of reducing agents can also be used which themselves have no reductive ability, but exhibit reductive ability by action of nucleophilic reagents or heat during the course of development.

Examples of the reducing agent for use in the present invention include reducing agents and precursors of reducing agents described in U.S. Pat. Nos. 4,500,626, column 49 and 50, 4,483,914, columns 30 and 31, 4,330,617 and 4,590,152, JP-A-60-140335, pages 17 and 18, JP-A-57-40245, JP-A-56-138736, JP-A-59-178458, JP-A-59-53831, JP-A-59-182449, JP-A-59-182450, JP-A-60-119555, JP-A-60-128436 to JP-A-60-128439, JP-A-60-198540, JP-A-60-181742, JP-A-61-259253, JP-A-62-244044, JP-A-62-131253, JP-A-62-131254, JP-A-62-131255, JP-A-62-131256 and EP 220,746 A2, pages 78 to 96.

Combinations of various reducing agents as disclosed in U.S. Pat. No. 3,039,869 can also be used.

When antidiffusive reducing agents are used, electron transfer agents and/or precursors thereof can be used in combination for accelerating electron transfer between the antidiffusive reducing agents and developable silver halides if necessary.

The electron transfer agents or the precursors thereof can be selected from the above described reducing agent or the precursor thereof. It is desirable that the electron transfer agents or the precursors thereof have a higher mobility than the antidiffusive reducing agents (electron donors). Particularly useful electron transfer agents are 1-phenyl-3-pyrazolidone compounds and aminophenol compounds.

The antidiffusive reducing agent (electron donor) for use in combination with the electron transfer agent may be any of the above-described reducing agents as long as they do not substantially move in a layer of the light-sensitive element. Preferred examples thereof include hydroquinone compounds, sulfonamidophenol compounds, sulfonamidonaphthol compounds, compounds described in JP-A-53-110827 as an electron donor, and antidiffusive, reductive dye-donating compounds described below.

In the present invention, the addition amount of the reducing agents is preferably from 0.001 mol to 20 mol, and more preferably from 0.01 mol to 10 mol, per mol of silver.

In the present invention, silver can be used as an image forming substance. The image forming substance also includes a compound which forms or releases a mobile dye when silver ion is reduced to silver at a high temperature, corresponding to or reversely corresponding to the reduction reaction, namely a dye-donating compound.

Examples of the dye-donating compound for use in the present invention include compounds which forms a dye by an oxidation coupling reaction (coupler). The coupler may be either a 4-equivalent coupler or a 2-equivalent coupler. Further, 2-equivalent couplers which has an antidiffusive group as a releasing group and forms a diffusive dye by an oxidation coupling reaction are also preferred. The antidiffusive group may form a polymer chain. Examples of a color developing agent and the coupler are described in detail in T. H. James, *The theory of the Photographic Process*, the fourth edition, pages 291 to 334 and 354 to 361, JP-A-58-123533, JP-A-58-149046, JP-A-58-149047, JP-A-59-111148, JP-A-59-124399, JP-A-59-174835, JP-A-59-231539, JP-A-59-231540, JP-A-60-2950, JP-A-60-2951, JP-A-60-14242, JP-A-60-23474 and JP-A-60-66249.

Other examples of the dye-donating compound include compounds having a function of releasing or diffusing a diffusive dye imagewise. The compounds of this type can be represented by the following general formula (LI):

$$(\text{Dye-Y})^n\text{—Z (LI)}$$

wherein Dye represents a dye group, a dye group temporarily shifted to a short wavelength, or a dye precursor group; Y represents only a bond or a bonding group; Z represents a group having the property of causing the difference in diffusibility of the compound represented by $(\text{Dye-Y})^n$—-Z corresponding to or reversely corresponding to a light-sensitive silver salt having a latent image imagewise, or of releasing Dye to produce the difference in diffusibility between the released Dye and $(\text{Dye-Y})^n$—Z; n represents 1 or 2; and when n is 2, two Dye-Y moieties may be the same or different.

Specific examples of the dye-donating compounds represented by general formula (LI) include the following compounds (1) to (5). The compounds (1) to (3) form a diffusive dye image (positive dye image) in reverse correspondence to the development of a silver halide, and the compounds (4) and (5) form a diffusive dye image (negative dye image) in correspondence to the development of a silver halide.

(1) Dye-developing agents in which a hydroquinone developing agent and a dye component are connected to each other, which are described in U.S. Pat. Nos. 3,134,764, 3,362,819, 3,597,200, 3,544,545 and 3,482,972. These dye-developing agents are diffusive under alkaline conditions, but react with a silver halide to become nondiffusive.

(2) Nondiffusive compounds can also be used which release a diffusive dye under alkaline conditions, but react with a silver halide to lose their capability, as described in U.S. Pat. No. 4,503,137. Examples thereof include compounds which release a diffusive dye by intermolecular nucleophilic substitution reaction as described in U.S. Pat. No. 3,980,479, and compounds which release a diffusive dye by intermolecular rearrangement of isooxazolone rings as described in U.S. Pat. No. 4,199,354.

(3) Nondiffusive compounds can also be used which react with a reducing agent left unoxidized on development to release a diffusive dye as described in U.S. Pat. No. 4,559,290, EP 220,746 A2, U.S. Pat. No. 4,783,396 and JIII Journal of Technical Disclosure 87-6199.

Examples thereof include compounds which release a diffusive dye by an intermolecular nucleophilic substitution reaction after reduction as described in U.S. Pat. Nos. 4,139,389and 4,139,379, JP-A-59-185333 and JP-A-57-84453, compounds which release a diffusive dye by the intermolecular electron migration reaction after reduction as described in U.S. Pat. No. 4,232,107, JP-A-59-101649, JP-A-61-88257, RD 24025 (1984), compounds which release a diffusive dye by cleavage of a single bond after reduction as described in West German Patent 3,008,588 A, JP-A-56-142530, U.S. Pat. Nos. 4,343,893 and 4,619,884, nitro compounds which release a diffusive dye after electron acceptance as described in U.S. Pat. No. 4,450,223, and compounds which release a diffusive dye after electron acceptance as described in U.S. Pat. No. 4,609,610.

Preferred examples thereof include compounds each having an N—X bond (wherein X represents an oxygen atom, a sulfur atom or a nitrogen atom) and an electron-attracting group in one molecule as described in EP 220,746 A2, JIII Journal of Technical Disclosure 87-6199, U.S. Pat. No. 4,783,396, JP-A-63-201653 and JP-A-63-201654, compounds each having a $SO_2$—X bond (wherein X has the same meaning as given above) and an electron-attracting group in one molecule as described in JP-A-1-26842, compounds each having a PO—X bond (wherein X has the same meaning as given above) and an electron-attracting group in one molecule as described in JP-A-63-271344, and compounds each having a C—X' bond (wherein X' has the same meaning as that of the above X, or represents —$SO_2$—) and an electron-attracting group in one molecule as described in JP-A-63-271341. Further, compounds described in JP-A-1-161237 and JP-A-1-161342 can also be used in which a single bond is cleaved by a $\pi$ bond conjugated with an electron-accepting group after reduction to release a diffusive dye.

Of these, the compounds having an N—X bond and an electron attractive group in one molecule are particularly preferred. Examples thereof include compounds (1) to (3), (7) to (10), (12), (13), (15), (23) to (26), (31), (32), (35), (36), (40), (41), (44), (53) to (59), (64) and (70) described in EP 220,746 A2 or U.S. Pat. No. 4,783,396 and compounds (11) to (23) described in JIII Journal of Technical Disclosure 87-6199.

(4) Coupler compounds (DDR couplers) which has a diffusive dye as a releasing group and release the diffusive dye by the reaction with an oxidant of a reducing agent. Examples thereof include compounds described in British Patent 1,330,524, JP-B-48-39165, U.S. Pat. Nos. 3,443,940, 4,474,867 and 4,483,914.

(5) Compounds (DRR compounds) which are reductive to a silver halide or an organic silver salt, and reduce them to release a diffusive dye. These compounds are not required to be used together with other reducing agents, and therefore preferably have no problem of contamination of images due to decomposed products by oxidation. Typical examples thereof are described in U.S. Pat. Nos. 3,928,312, 4,053,312, 4,055,428 and 4,336,322, JP-A-59-65839, JP-A-59-69839, JP-A-53-3819, JP-A-51-104343, RD 17465, U.S. Pat. Nos. 3,725,062, 3,728,113 and 3,443,939, JP-A-58-116537, JP-A-57-179840 and U.S. Pat. No. 4,500,626. Examples of the DRR compound include compounds described in U.S. Pat. No. 4,500,626, columns 22 to 44, described above. Of these, compounds (1) to (3), (10) to (13), (16) to (19), (28) to (30), (33) to (35), (38) to (40) and (42) to (64) described in the above described U.S. Patent are preferred. Compounds described in U.S. Pat. No. 4,639,408, columns 37 to 39, are also useful.

In addition, as the above-described coupler, or dye-donating compound other than the compound represented by general formula (LI), there can be used dye silver compounds in which an organic silver salt and a dye are connected (RD, May 1978, pages 54 to 58), azo dyes used for the heat development silver dye bleaching process (U.S. Pat. No. 4,235,957 and RD, April 1976, pages 30 to 32) and leuco dyes (U.S. Pat. Nos. 3,985,565 and 4,022,617).

The hydrophobic additives such as the dye-donating compound and the antidiffusive reducing agent can be introduced into a layer of the light-sensitive element by known methods such as methods described in U.S. Pat. No. 2,322,027. In this case, high boiling organic solvents as described in JP-A-59-83154, JP-A-59-178451, JP-A-59-178452, JP-A-59-178453, JP-A-59-178454, JP-A-59-178455 and JP-A-59-178457 can be used in combination with a low boiling organic solvent having a boiling point of from 50° C. to 160° C. if necessary.

The use amount of the high boiling organic solvent is 10 g or less, and preferably 5 g or less, per gram of the dye-donating compound to be used. Further, it is 1 cc or less, preferably 0.5 cc or less, and more preferably 0.3 cc or less, per gram of a binder.

Dispersing methods by means of a polymerized product described in JP-B-51-39853 and JP-A-51-59943 can also be used.

The compounds substantially insoluble in water can be dispersed in a binder after making it into fine grains to add, in addition to the above-described methods.

When the hydrophobic compounds are dispersed in hydrophilic colloids, various surfactants can be used. For example, surfactants described in JP-A-59-157636, pages 37 and 38 can be used.

In the light-sensitive element-for use in the present invention, compounds for activating development and for stabilizing images can be used. Preferred examples of such compounds are described in U.S. Pat. No. 4,500,626, columns 51 and 52.

In the layers constituting the light-sensitive element or the dye-fixing element, a high boiling organic solvent can be used as a plasticizer, a slipping agent or a separation improver of the dye-fixing element from the light-sensitive element. Examples thereof include solvents described in JP-A-62-253159, page 25 and JP-A-62-245253.

Further, for the above-described purposes, various silicone oils (all silicone oils including dimethylsilicone oils and modified silicone oils in which various organic groups are introduced into dimethyl-siloxanes) can be used as the above-described agents. Effective examples thereof include various modified silicone oils described in *Modified Silicone Oils*, Technical Reference P6-18B, published by Shinetsu Silicone Co., Ltd., particularly carboxy-modified silicone (trade name: X-22-3710).

Further, silicone oils described in JP-A-62-215953 and JP-A-63-46449 are also effective.

Fading preventives may be used in the light-sensitive element and/or the dye-fixing element. The fading preventives include, for example, antioxidants, ultraviolet absorbents and some kinds of metal complexes.

The antioxidants include chroman compounds, coumaran compounds, phenol compounds (for example, hindered phenols), hydroquinone derivatives, hindered amine derivatives and spiroindane compounds. Compounds described in JP-A-61-159644 are also effective.

The ultraviolet absorbents include benzotriazole compounds (U.S. Pat. No. 3,533,794), 4-thiazolidone compounds (U.S. Pat. No. 3,352,681), benzophenone compounds (JP-A-46-2784), and compounds described in JP-A-54-48535, JP-A-62-136641 and JP-A-61-88256. Ultraviolet absorbing polymers described in JP-A-62-260152 are also effective.

The metal complexes include compounds described in U.S. Pat. Nos. 4,241,155, 4,245,018, columns 3 to 36, and 4,254,195, columns 3 to 8, JP-A-62-174741, JP-A-61-88256, pages 27 to 29, JP-A-63-199248, JP-A-1-75568 and JP-A-1-74272.

Useful examples of the fading preventive are described in JP-A-62-215272, pages 125 to 137.

The fading preventives for preventing the fading of dyes transferred to the dye-fixing element may be previously added to the dye-fixing element, or may be supplied from the outside, for example, from the light-sensitive element, to the dye-fixing element.

The above-described antioxidants, ultraviolet absorbents and metal complexes may be used in combination.

Fluorescent brightening agents may be used in the light-sensitive element and/or the dye-fixing element. In particular, it is preferred that the fluorescent brightening agents are contained in the dye-fixing element, or supplied from the outside, for example, from the light-sensitive element. Examples of the fluorescent brightening agents include compounds described in *The Chemistry of Synthetic Dyes*, Vol. V, Chap. 8, edited by K. Veenkataraman and JP-A-61-143752. More specifically, they include stilbene compounds, coumarin compounds, biphenyl compounds, benzoxazolyl compounds, naphthalimide compounds, pyrazoline compounds and carbostyryl compounds.

The fluorescent brightening agent can be used in combination with the fading preventive.

A hardener for use in the layers constituting the light-sensitive element and the dye-fixing element include hardeners described in U.S. Pat. Nos. 4,678,739, column 41, JP-A-59-116655, JP-A-62-245261 and JP-A-61-18942. More specifically, examples thereof include aldehyde hardeners (such as formaldehyde), aziridine hardeners, epoxy hardeners, vinylsulfone hardeners (such as N,N'-ethylenebis (vinylsulfonylacetamido)ethane), N-methylol hardeners (dimethylolurea) and polymer hardeners (compounds described in JP-A-62-234157).

In the layers constituting the light-sensitive element and the dye-fixing element, various surfactants can be used for assisting coating, improving separation, improving slipperiness, preventing electric charge and for accelerating development. Examples of the surfactants are described in JP-A-62-173463 and JP-A-62-183457.

The layers constituting the light-sensitive element and the dye-fixing element may contain organic fluoro compounds for improving slipperiness, preventing electric charge and for improving separation. Typical examples of the organic fluoro compound include fluorine surfactants described in JP-B-57-9053, columns 8 to 17, JP-A-61-20944 and JP-A-62-135826, and hydrophobic fluorine compounds such as oily fluorine compounds (for example, fluorine oils) and solid fluorine compounds (for example, ethylene tetrafluoride resins).

Matte agents can be used in the light-sensitive element and the dye-fixing element. The matte agents include compounds such as benzoguanamine resin beads, polycarbonate resin beads and AS resin beads described in JP-A-63-274944 and JP-A-63-274952, as well as compounds such as silicon dioxide, polyolefins and polymethacrylates described in JP-A-61-88256, page 29.

Besides the above, the layers constituting the light-sensitive element and the dye-fixing element may contain a heat solvent, an antifoaming agent, a microbicidal antifungal agent and a colloidal silica. Examples of these additives are described in JP-A-61-88256, pages 26 to 32.

In the present invention, an image formation accelerating agent can be used in the light-sensitive element and/or the dye-fixing element. The image formation accelerating agent has the functions of accelerating the oxidation-reduction reaction of a silver salt oxidizing agent with a reducing agent, of accelerating reaction such as formation or decomposition of dyes derived from dye-donating substances, or release of diffusive dyes, and of accelerating the movement of dyes from the light-sensitive element to the dye-fixing element, and can be classified into bases or base precursors, nucleophilic compounds, high boiling organic solvents (oils), heat solvents, surfactants, compounds having interaction with silver or silver ions according to the physicochemical functions. However, these group of substances generally have combined functions, and therefore, they have usually a combinations of some of the abovedescribed accelerating effects. The details thereof are described in U.S. Pat. No. 4,678,739, columns 38 to 40.

The base precursors include salts of an organic acid which is decarboxylated by heat with a base, and compounds releasing amines by the intramolecular nucleophilic displacement reaction, the Lossen rearrangement or the Beckmann rearrangement. Examples thereof are described in U.S. Pat. Nos. 4,511,493 and JP-A-62-65038.

In the system in which heat development and dye transfer are conducted at the same time in the presence of a trace amount of water, it is preferred to add the base and/or the base precursor to the dye-fixing element for enhancing storage stability of the light-sensitive element.

In addition to the above, combinations of slightly soluble metal compounds and compounds (hereinafter referred to as complex forming compounds) which are capable of conducting the complex forming reaction with metal ions constituting the slightly soluble metal compounds described in EP 210,660 A and U.S. Pat. No. 4,740,445, and compounds producing a base by electrolysis described in JP-A-61-232451 can be used as the base precursor. In particular, the former is effective. It is preferred that the slightly soluble metal compounds and the complex forming compounds are separately added to the light-sensitive element and the dye-fixing element, respectively.

In the present invention, various development stoppers can be used in the light-sensitive element and/or the dye-fixing element for stably obtaining constant images against fluctuations in processing temperature and processing time on development.

The "development stopper" as used herein is a compound which, after appropriate development, rapidly neutralizes or reacts with a base to reduce the concentration of the base contained in a film, thereby stopping development, or a compound which interacts with silver and a silver salt to inhibit development. Specific examples thereof include acid precursors which release an acid by heating, electrophilic compounds which conduct the replacement reaction with a coexisting base by heating, nitrogen-containing heterocyclic compounds, mercapto compounds and precursors thereof. More specifically, they are described in JP-A-62-253159, pages 31 and 32.

In the present invention, supports which can endure the processing temperature are used as supports for the light-sensitive element and the dye-fixing element. In general, the supports include paper and synthetic polymers (films). Specifically, there are used polyethylene terephthalate, polycarbonates, polyvinyl chloride, polystyrene, polypropylene, polyimides, cellulose derivatives (for example, cellulose triacetate), films thereof containing a pigment such as titanium oxide, synthetic paper produced from polypropylene by a film method, mixed paper produced from pulp of a synthetic resin such as polyethylene and natural pulp, Yankee paper, baryta paper, coated paper (particularly, cast-coated paper), metals, cloth or glass.

They can be used as it is or as coated with a synthetic polymer such as polyethylene on one side or both sides.

In addition, supports described in JP-A-62-253159, pages 29 to 31 can be used.

Surfaces of these supports may be coated with a hydrophilic binder and a semiconductive metal oxide such as alumina sols and tin oxide, or with an antistatic agent such as carbon black.

Methods for exposing the light-sensitive element to record an image include, for example, methods of directly taking landscape photographs or human subject photographs by use of cameras, methods of exposing the light-sensitive element through a reversal film or a negative film by use of a printer or an enlarger, methods of subjecting original pictures to scanning exposure through slits by use of an exposing device of a copying machine, methods of allowing a light emitting diode or various laser to emit light in accordance with image information through electric signals to expose the light-sensitive element, and methods of inputting image information to an image display such as CRTs, liquid crystal displays, electroluminescence displays and plasma displays to expose the light-sensitive element directly or through an optical system.

Light sources such as natural light, tungsten lamps, light emitting diodes, laser sources and CRT light sources described in U.S. Pat. No. 4,500,626, column 56 can be used to record images on the light-sensitive element.

Further, images can also be exposed using a wavelength-converting element in which a non-linear optical material is combined with a coherent light source such as a laser beam. Here, the non-linear optical material is a material which can exhibit non-linearity between an electrical field and polarization appearing when a strong optical electrical field such as a laser beam is given. Examples of such materials preferably used include inorganic compounds represented by lithium niobate, potassium dihydrogenphosphate (KDP), lithium iodate and $BaB_2O_4$, urea derivatives, nitroaniline derivatives, nitropyridine-N-oxide derivatives such as 3-methyl-4-nitropyridine-N-oxide (POM), and compounds described in JP-A-61-53462 and JP-A-62-210432. As the form of the wavelength converting element, the single crystal optical waveguide path type and the fiber type are known, and both are useful for use in the present invention.

Furthermore, as the above-described image information, there can be utilized image signals obtained from video cameras or electronic still cameras, television signals represented by the Nippon Television Signal Criteria (NTSC), image signals obtained by dividing original pictures into many picture elements with scanners and image signals produced by use of computers represented by CGs and CADs.

The light-sensitive element and/or the dye-fixing element may have an electrically conductive heating layer as heating means for heat development or diffusion transfer of a dye. In this case, transparent or opaque heating elements described in JP-A-61-145544 can be utilized. These conductive layers also function as an antistatic layer.

For the heating temperature in the heat development stage, the development can be achieved at from about 50° C. to about 250° C. However, it is particularly useful to conduct the development from at about 80° C. to about 180° C. The diffusion transfer of a dye may be performed either simultaneously with the heat development or after the heat development. In the latter case, transfer step can be performed at a heating temperature at a temperature ranging from the temperature at which the heat development stage is conducted to room temperature. In particular, the temperature is more preferably not less than 50° C. and lower than the temperature at which the heat development stage is conducted by 10° C.

The movement of a dye is induced only by heat. However, a solvent may also be used for accelerating the movement of a dye. It is also useful that heating is carried out in the presence of a trace amount of solvent (particularly water) to conduct development and transfer at the same time or successively as described in detail in JP-A-59-218443 and JP-A-61-238056. In this system, the heating temperature is preferably from 50° C. to the boiling point of the solvent used. For example, when the solvent is water, the temperature is desirably from 50° C. to 100° C.

Examples of the solvent used for the acceleration of development and/or the movement of the diffusive dye to the dye-fixing layer include water and basic aqueous solutions containing an inorganic alkali metal salt or an organic base (those exemplified above for the image formation accelerating agents are used as the bases). Low boiling solvents or mixed solvents of a low boiling solvent with water or with a basic aqueous solution can also be used. Further, the solvent may contain a surfactant, an antifoggant or a complex forming compound with a slightly soluble metal salt.

These solvents can be added to the dye-fixing element or the light-sensitive element, or both of them. The use amount of the solvent is only required to be as small as not more than the weight of the solvent corresponding to the maximum swelled volume of the whole coated films (particularly, not more than the weight obtained by the subtraction of the weight of the whole coated films from the weight of the solvent corresponding to the maximum swelled volume of the whole coated films).

Examples of the method for adding the solvent to the light-sensitive layer or the dye-fixing layer include methods described in JP-A-61-147244, page 26. Further, a solvent encapsulated in microcapsules can also be previously contained in the light-sensitive element or the dye-fixing element or both of them.

In order to accelerate the movement of a dye, a hydrophilic heat solvent which are solid at ordinary temperature and become soluble at a high temperature can also be contained in the light-sensitive element or the dye-fixing element. The hydrophilic heat solvent may be contained in any of the light-sensitive element and the dye-fixing element or both of them. Further, they may be contained in any of an emulsion layer, an intermediate layer, a protective layer and a dye-fixing layer. However, it is preferably contained in the dye-fixing layer and/or the layers adjacent thereto.

Examples of the hydrophilic heat solvent include urea derivatives, pyridine derivatives, amides, sulfonamides, imides, alcohols, oximes and other heterocyclic compounds.

Further, in order to accelerate the movement of a dye, a high boiling organic solvent may be contained in the light-sensitive element and/or the dye-fixing element.

Examples of a heating method for use in the development and/or transfer stage include methods of bringing the light-sensitive element or the dye-fixing element into contact with a heated block, a heated plate, a hot presser, heat rolls, heat drums, a halogen lamp heater, infrared or far infrared lamp heater, and methods of passing them through an atmosphere of a high temperature.

When the light-sensitive element and the dye-fixing element are superposed on and adhered to each other, the pressure conditions and methods for applying the pressure described in JP-A-61-147244, page 27 can be utilized.

Any of various heat development apparatuses can be used for processing the photographic elements in the present invention. For example, apparatuses described in JP-A-59-75247, JP-A-59-177547, JP-A-59-181353, JP-A-60-18951 and JP-A-U-62-25994 (the term "JP-A-U" as used herein means an "unexamined published Japanese utility model application") are preferably used.

As commercially available heat development apparatuses, Pictrostat 200 and Pictrography 3000 manufactured by Fuji Photo Film Co., Ltd. are preferably used.

The present invention will be described in more detail with reference to the following Examples, but the invention should not be construed as being limited thereto.

EXAMPLE 1

Preparation of Light-Sensitive Silver Halide Emulsion (1) (Emulsion for Fifth Layer)

Solutions (I) and (II) shown in Table 2 were concurrently added to an aqueous solution having the composition shown in Table 1 over 13 minutes while sufficiently stirring. Ten minutes after the completion of the addition, solutions (III) and (IV) shown in Table 2 were added over 33 minutes.

TABLE 1

| | |
|---|---|
| $H_2O$ | 620 cc |
| Lime-Treated Gelatin | 20 g |
| KBr | 0.3 g |
| NaCl | 2 g |
| Solvent for Silver Halide (1) | 0.030 g |
| Sulfuric Acid (1 N) | 16 cc |
| Temperature | 45° C. |

TABLE 2

| | Solution (I) | Solution (II) | Solution (III) | Solution (IV) |
|---|---|---|---|---|
| $AgNO_3$ | 30.0 g | — | 70.0 g | — |
| KBr | — | 13.7 g | — | 44.2 g |
| NaCl | — | 3.62 g | — | 2.4 g |
| $K_2IrCl_6$ | — | — | — | 0.039 mg |
| Total Amount | Water to make 126 ml | Water to make 132 ml | Water to make 254 ml | Water to make 252 ml |

Solvent for Silver Halide (1)

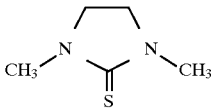

After an elapse of 13 minutes from the start of the addition of solution (III), 150 cc of a 0.35% aqueous solution of sensitizing dye (1) was added over 27 minutes.

Sensitizing Dye (1)

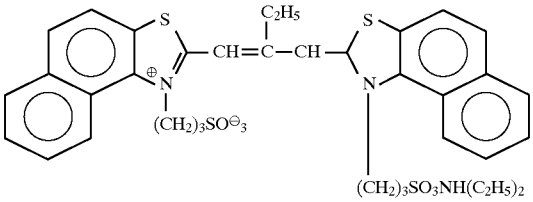

After conventional washing and salt removal (conducted at pH 4.1 using precipitant (a)), 22 g of lime-treated ossein gelatin was added. After adjustment to pH 6.0 and pAg 7.9, chemical sensitization was carried out at 60° C. Compounds used in the chemical sensitization are as shown in Table 3. Thus, a monodisperse cubic silver chlorobromide emulsion having a coefficient of fluctuation of 10.2% was obtained. The yield of the resulting emulsion was 630 g, and the mean grain size was 0.20 μm.

TABLE 3

Precipitant (a)

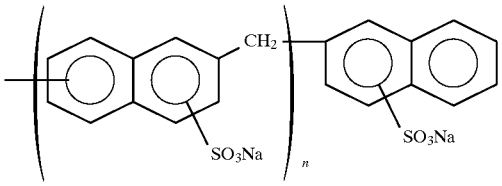

Precipitant (b)

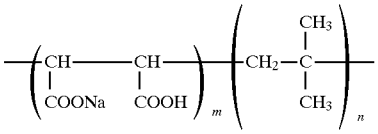

| Agents used in Chemical Sensitization | Addition Amount |
|---|---|
| 4-Hydroxy-6-methyl-1,3,3a,7-tetrazaindene | 0.36 g |
| Sodium Thiosulfate | 6.75 mg |
| Antifoggant (1) | 0.11 g |
| Preservative (1) | 0.07 g |
| Preservative (2) | 3.13 g |

Antifoggant (1)

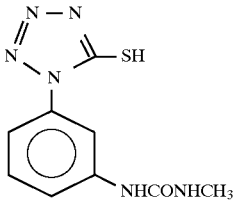

Preservative (1)

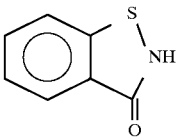

Preservative (2)

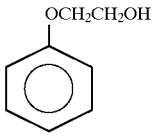

Preservative (3)

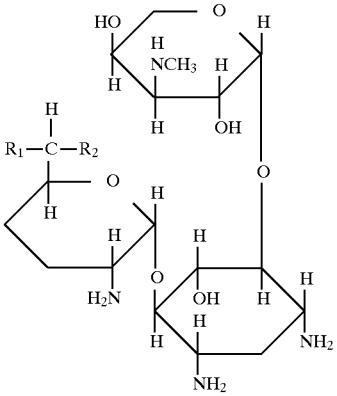

Mixture of

| ($R_1$) | ($R_2$) |
|---|---|
| $H_3C$— | —$NHCH_3$ |
| $H_3C$— | —$NH_2$ |
| H— | —$NH_2$ |
| H— | —$NHCH_3$ |

Preparation of Light-Sensitive Silver Halide Emulsion (2) (Emulsion for Third Layer)

Solutions (I) and (II) shown in Table 5 were concurrently added to an aqueous solution having the composition shown in Table 4 over 18 minutes while sufficient stirring. Ten minutes after the completion of the addition, solutions (III) and (IV) shown in Table 5 were added over 24 minutes.

TABLE 4

| | |
|---|---|
| $H_2O$ | 620 cc |
| Lime-Treated Gelatin | 20 g |
| KBr | 0.3 g |
| NaCl | 2 g |
| Solvent for Silver Halide (1) | 0.030 g |
| Sulfuric Acid (1 N) | 16 cc |
| Temperature | 45° C. |

TABLE 5

| | Solution (I) | Solution (II) | Solution (III) | Solution (IV) |
|---|---|---|---|---|
| $AgNO_3$ | 30.0 g | — | 70.0 g | — |
| KBr | — | 13.7 g | — | 44.2 g |
| NaCl | — | 3.62 g | — | 2.4 g |
| $K_4[Fe(CN)_6].H_2O$ | | | | 0.07 g |
| $K_2IrCl_6$ | — | — | — | 0.040 mg |
| Total Amount | Water to make 188 ml | Water to make 188 ml | Water to make 250 ml | Water to make 250 ml |

After conventional washing and salt removal (conducted at pH 3.9 using precipitant (b)), 22 g of delimed lime-treated ossein gelatin (having a calcium content of 150 ppm or less) was added and dispersed again at 40° C. Then, 0.39 g of 4-hydroxy-6-methyl-1,3,3a,7-tetraazaindene was added, followed by adjusting the pH to 5.9 and the pAg to 7.8. Thereafter, chemical sensitization was conducted at 70° C. by use of agents shown in Table 6. At the end of the chemical sensitization, a solution of sensitizing dye (2) in methanol (solution having the composition shown in Table 7) was added. After the chemical sensitization, the temperature was lowered to 40° C., and 200 g of a gelatin dispersion of stabilizer (1) described below was added. After sufficient stirring, the resulting product was stored. Thus, a monodisperse cubic silver chlorobromide emulsion having a coefficient of fluctuation of 12.6% was obtained. The yield of the resulting emulsion was 938 g. The mean grain size was 0.25 $\mu$m.

TABLE 6

| Agents used in Chemical Sensitization | Addition Amount |
|---|---|
| 4-Hydroxy-6-methyl-1,3,3a,7-tetraazaindene | 0.39 g |
| Triethylthiourea | 3.3 mg |
| Decomposed Product of Nucleic Acid | 0.39 g |
| NaCl | 0.15 g |
| KI | 0.12 g |
| Antifoggant (2) | 0.10 g |
| Preservative (1) | 0.07 g |

Antifoggant (2)

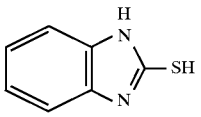

TABLE 7

| Composition of Dye Solution | Addition Amount |
|---|---|
| Sensitizing Dye (2) | 0.20 g |
| p-Toluenesulfonic Acid | 0.71 g |

TABLE 7-continued

| Composition of Dye Solution | Addition Amount |
|---|---|
| Methanol | 18.7 cc |
| Sensitizing Dye (2) | |

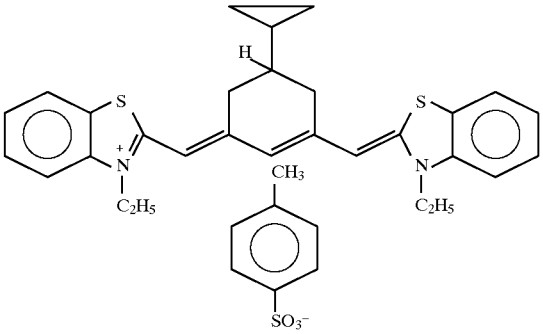

Preparation of Light-Sensitive Silver Halide Emulsion (3) (Emulsion for First Layer)

Solutions (I) and (II) shown in Table 9 were concurrently added to an aqueous solution having the composition shown in Table 8 for 18 minutes while sufficient stirring. Ten minutes after the completion of the addition, solutions (III) and (IV) shown in Table 9 were added over 24 minutes.

TABLE 8

| | |
|---|---|
| $H_2O$ | 620 cc |
| Lime-Treated Gelatin | 20 g |
| KBr | 0.3 g |
| NaCl | 2 g |
| Solvent for Silver Halide (1) | 0.030 g |
| Sulfuric Acid (1 N) | 16 cc |
| Temperature | 50° C. |

TABLE 9

| | Solution (I) | Solution (II) | Solution (III) | Solution (IV) |
|---|---|---|---|---|
| $AgNO_3$ | 30.0 g | — | 70.0 g | — |
| KBr | — | 13.7 g | — | 44.1 g |
| NaCl | — | 3.62 g | — | 2.4 g |
| $K_2IrCl_6$ | — | — | — | 0.020 mg |
| Total Amount | Water to make 180 ml | Water to make 181 ml | Water to make 242 ml | Water to make 250 ml |

After conventional washing and salt removal (conducted at pH 3.8 using precipitant (a)), 22 g of lime-treated ossein gelatin was added. After adjustment to pH 7.4 and pAg 7.8, chemical sensitization was carried out at 60° C. Compounds used in the chemical sensitization are as shown in Table 10. Thus, a monodisperse cubic silver chlorobromide emulsion having a coefficient of fluctuation of 9.7% was obtained. The yield of the resulting emulsion was 680 g. The mean grain size was 0.32 μm.

TABLE 10

| Agent Used in Chemical Sensitization | Amount Added |
|---|---|
| 4-Hydroxy-6-methyl-1,3,3a,7-tetraazaindene | 0.38 g |
| Triethylthiourea | 3.10 mg |
| Antifoggant (2) | 0.19 g |

TABLE 10-continued

| Agent Used in Chemical Sensitization | Amount Added |
|---|---|
| Preservative (1) | 0.07 g |
| Preservative (2) | 3.13 g |

Preparation of Gelatin Dispersion of Colloidal Silver

A solution having the composition shown in Table 12 was added to an aqueous solution having the composition shown in Table 11 for 24 minutes while sufficient stirring. Then, precipitant (a) was added thereto, and the resulting mixture was washed with water, followed by addition of 43 g of lime-treated ossein gelatin to adjust the pH to 6.3. A dispersion containing 2% of silver and 6.8% of gelatin was obtained. The mean grain size thereof was 0.02 μm, and the yield thereof was 512 g.

TABLE 11

| Composition | |
|---|---|
| $H_2O$ | 620 cc |
| Dextrin | 16 g |
| NaOH (5 N) | 41 cc |
| Temperature | 30° C. |

TABLE 12

| Composition | |
|---|---|
| $H_2O$ | 135 cc |
| $AgNO_3$ | 17 g |

Preparation of Gelatin Dispersion of Hydrophobic Additives

Gelatin dispersions of a yellow dye-donating compound, a magenta dye-donating compound and cyan dye-donating compounds were each prepared according to the formulation shown in Table 13. That is, the respective oily phase components were heated to about 70° C. to dissolve them, thereby forming a homogeneous solution. The aqueous phase components heated to about 60° C. were added thereto, and mixed with stirring, followed by dispersing with a homogenizer at 10000 rpm for 10 minutes. Water was added thereto, and the resulting mixture was stirred to obtain a homogeneous dispersion. For the gelatin dispersion of the cyan dye-donating compounds, dilution with water and concentration were further repeated by use of an ultrafiltration module (ACV-3050 manufactured by Asahi Chemical Industries Co., Ltd.) to reduce the amount of ethyl acetate shown in Table 13 to 1/17.6 the amount thereof.

TABLE 13

| | Dispersion Composition | | |
|---|---|---|---|
| | Yellow | Magenta | Cyan |
| Oily Phase | | | |
| Cyan Dye-donating Compound (1) | — | — | 7.3 g |
| Cyan Dye-donating Compound (2) | — | — | 10.7 g |
| Magenta Dye-donating Compound (1) | — | 14.7 g | — |
| Yellow Dye-donating Compound (1) | 12.3 g | — | — |
| Reducing Agent (1) | 0.9 g | 0.2 | 1.0 g |
| Antifoggant (3) | 0.1 g | — | 0.2 g |
| Antifoggant (4) | — | 0.7 g | — |
| Surfactant (1) | 1.1 g | — | — |

TABLE 13-continued

| | Dispersion Composition | | |
|---|---|---|---|
| | Yellow | Magenta | Cyan |
| High Boiling Solvent (1) | 6.2 g | — | 4.6 g |
| High Boiling Solvent (2) | — | 7.4 g | 4.9 g |
| High Boiling Solvent (3) | — | — | 1.2 g |
| Dye (a) | 1.1 g | — | 0.5 g |
| Water | 0.4 ml | — | — |
| Ethyl Acetate | 9.6 ml | 50.1 ml | 55.2 ml |
| Aqueous Phase | | | |
| Lime-Treated Gelatin | 10.0 g | 10.0 g | 10.0 g |
| Calcium Nitrate | 0.1 g | 0.1 g | — |
| Surfactant (1) | — | 0.2 g | 0.8 g |
| Aqueous Solution of NaOH (1 N) | — | 1.9 ml | — |
| Carboxymethyl Cellulose | — | — | 0.3 g |
| Water | 26.1 ml | 139.7 ml | 95.9 ml |
| Water to Make | 99.9 ml | 157.3 ml | 209.0 ml |
| Preservative (1) | 0.004 g | 0.04 g | 0.1 g |

Preparation of Gelatin Dispersion of Reducing Agent (2)

A gelatin dispersion of reducing agent (2) was prepared according to the formulation shown in Table 14. That is, the respective oily phase components were heated to about 60° C. to dissolve them, and the aqueous phase components heated to about 60° C. were added thereto. The mixture was stirred, followed by dispersing with a homogenizer at 10000 rpm for 10 minutes to obtain a homogeneous dispersion. Further, ethyl acetate was removed from the resulting dispersion by use of an organic solvent vacuum-removing device.

TABLE 14

| | Dispersion Composition |
|---|---|
| Oily Phase | |
| Reducing Agent (2) | 7.5 g |
| High Boiling Solvent (1) | 4.7 g |
| Surfactant (1) | 1.9 g |
| Ethyl Acetate | 14.4 ml |
| Aqueous Phase | |
| Acid-Treated Gelatin | 10.0 g |
| Preservative (1) | 0.02 g |
| Preservative (3) | 0.04 g |
| Sodium Hydrogensulfite | 0.1 g |
| Water | 136.7 ml |

Preparation of Gelatin Dispersion of Stabilizer (1)

A gelatin dispersion of stabilizer (1) was prepared according to the formulation shown in Table 15. That is, the respective oily phase components were dissolved at room temperature, and the aqueous phase components heated to about 40° C. were added thereto. The mixture was stirred, followed by dispersing with a homogenizer at 10000 rpm for 10 minutes. Water was added thereto, followed by stirring to obtain a homogeneous dispersion.

TABLE 15

| | Dispersion Composition |
|---|---|
| Oily Phase | |
| Stabilizer (1) | 4.0 g |
| Sodium Hydroxide | 0.3 g |
| Methanol | 62.8 g |
| High Boiling Solvent (4) | 0.9 g |
| Aqueous Phase | |
| Delimed Treated Gelatin (Ca content: 100 ppm or less) | 10.0 g |
| Preservative (1) | 0.04 g |

Preparation of Gelatin Dispersion of Zinc Hydroxide

A gelatin dispersion of zinc hydroxide was prepared according to the formulation shown in Table 16. That is, the respective components were mixed and dissolved, followed by dispersing with glass beads having a mean grain size of 0.75 mm in a mil for 30 minutes. Then, the glass beads were removed to obtain a homogeneous dispersion. (The mean grain size of Zinc hydroxide used is 0.25 $\mu$m).

TABLE 16

| | Dispersion Composition |
|---|---|
| Zinc Hydroxide | 15.9 g |
| Carboxymethyl Cellulose | 0.7 g |
| Polysodium Acrylate | 0.07 g |
| Lime-Treated Gelatin | 4.2 g |
| Water | 100 ml |
| High Boiling Solvent (4) | 0.4 g |

Preparation of Gelatin Dispersion of Matte Agent

A gelatin dispersion of a matte agent added to a protective layer was prepared in the following manner. That is, a solution of PMMA in methylene chloride was added to gelatin together with a small amount of a surfactant, and dispersed by high-speed stirring. Subsequently, methylene chloride was removed by use of an organic solvent vacuum-removing device to obtain a homogeneous dispersion having a mean grain size of 4.3 $\mu$m.

Cyan Dye-donating Compound (1)
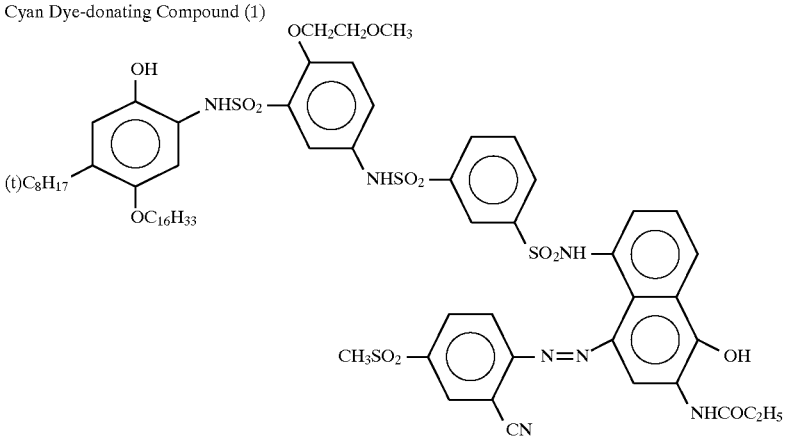
Cyan Dye-donating Compound (2)
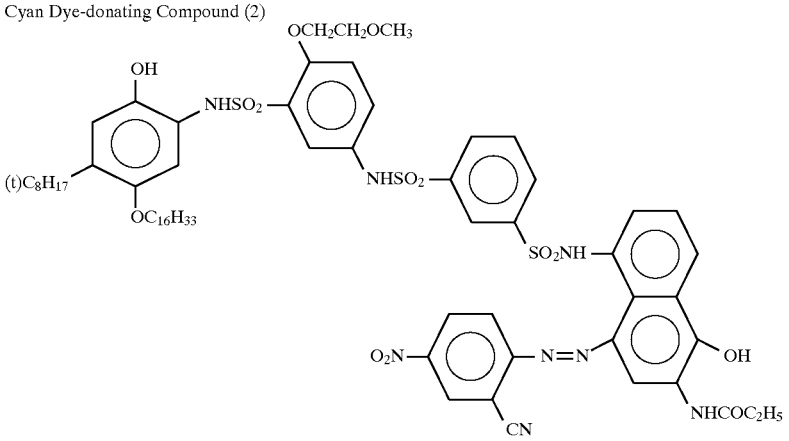
Magenta Dye-donating Compound (1)
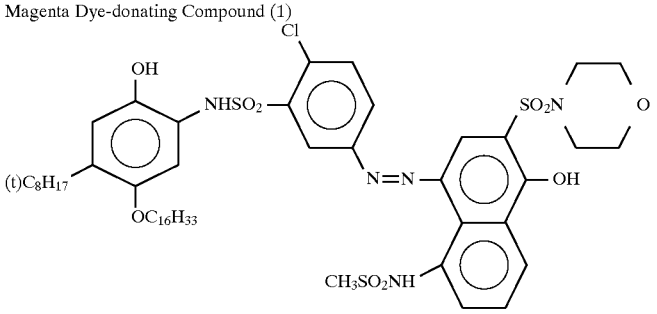
Yellow Dye-donating Compound (1)
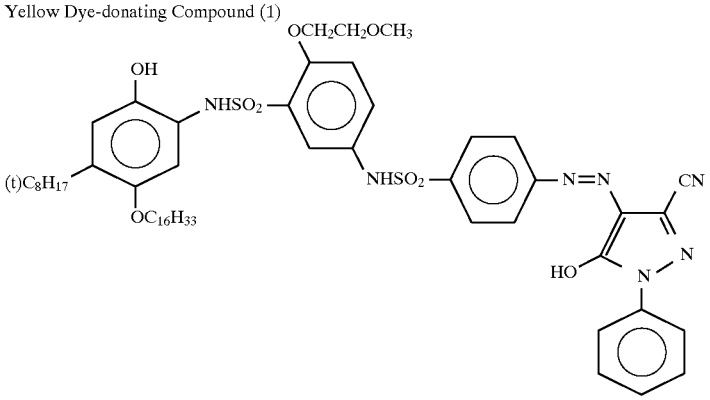

-continued
Reducing Agent (1)
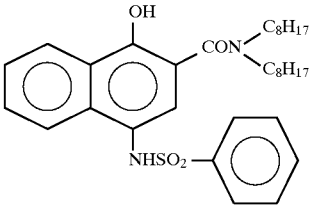
Antifoggant (3)
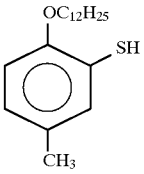
Antifoggant (4)
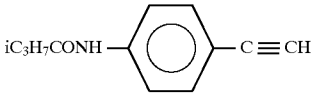
Surfactant (1)
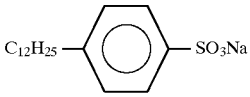
High Boiling Solvent (1)
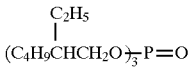
High Boiling Solvent (2)
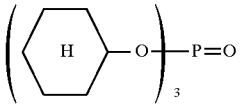
High Boiling Solvent (3)
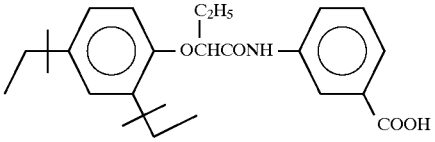
Dye (a)
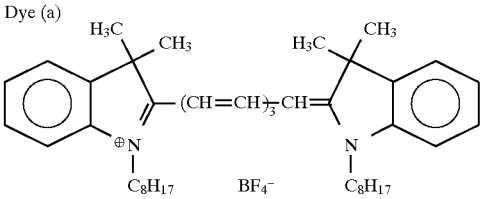
Reducing Agent (2)
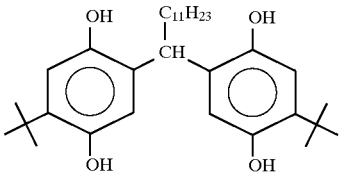

-continued

Stabilizer (1)

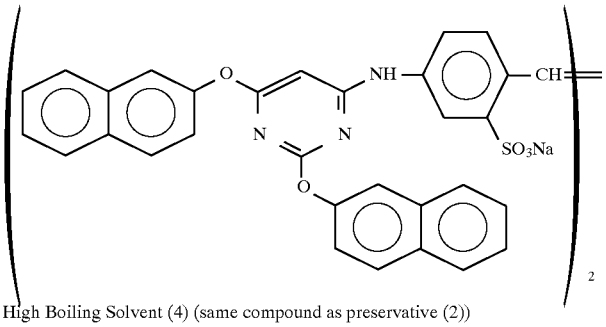

High Boiling Solvent (4) (same compound as preservative (2))

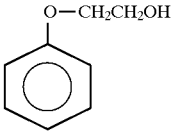

Using the materials described above, heat developable light-sensitive material 101 shown in Table 17 was prepared.

TABLE 17

MAIN MATERIAL CONSTITUTION OF HEAT DEVELOPABLE LIGHT-SENSITIVE MATERIAL 101

| Layer No. | Layer Name | Additive | Amount Coated ($mg/m^2$) |
|---|---|---|---|
| 7th Layer | Protective Layer | Acid-Treated Gelatin | 442 |
| | | Reducing Agent (2) | 47 |
| | | High Boiling Solvent (1) | 30 |
| | | Colloidal Silver Grains | 2 |
| | | Matte Agent (PMMA Resin) | 17 |
| | | Surfactant (2) | 16 |
| | | Surfactant (1) | 9 |
| | | Surfactant (3) | 2 |
| 6th Layer | Intermediate Layer | Lime-Treated Gelatin | 862 |
| | | Zinc Hydroxide | 480 |
| | | Water-Soluble Polymer (1) | 4 |
| | | Surfactant (2) | 0.4 |
| | | Calcium Nitrate | 14 |
| 5th Layer | Red Light-Sensitive Layer | Lime-Treated Gelatin | 452 |
| | | Light-Sensitive Silver Halide Emulsion (1) | 301 (in terms of silver) |
| | | Magenta Dye-donating Compound (1) | 441 |
| | | High Boiling Solvent (2) | 221 |
| | | Reducing Agent (1) | 6 |
| | | Antifoggant (4) | 20 |
| | | Surfactant (1) | 0.3 |
| | | Water-Soluble Polymer (1) | 11 |
| 4th Layer | Intermediate Layer | Lime-Treated Gelatin | 485 |
| | | Zinc Hydroxide | 270 |
| | | Water-Soluble Polymer (1) | 2 |
| | | Surfactant (2) | 0.3 |
| | | Calcium Nitrate | 8 |
| 3rd Layer | Second Infrared Light-Sensitive Layer | Lime-Treated Gelatin | 373 |
| | | Light-Sensitive Silver Halide Emulsion (2) | 106 (in terms of silver) |
| | | Stabilizer (1) | 9 |
| | | Cyan Dye-donating Compound (2) | 233 |
| | | Cyan Dye-donating Compound (1) | 159 |
| | | Dye (a) | 10 |

TABLE 17-continued

| | | | |
|---|---|---|---|
| | | High Boiling Solvent (1) | 101 |
| | | High Boiling Solvent (2) | 108 |
| | | High Boiling Solvent (3) | 27 |
| | | Reducing Agent (1) | 22 |
| | | Antifoggant (3) | 4 |
| | | Surfactant (1) | 0.9 |
| | | Carboxymethyl Cellulose | 5 |
| | | Water-Soluble Polymer (1) | 11 |
| 2nd Layer | Intermediate Layer | Lime-Treated Gelatin | 438 |
| | | Surfactant (2) | 4 |
| | | Surfactant (4) | 123 |
| | | Water-Soluble Polymer (2) | 26 |
| | | Antifoggant (5) | 6 |
| | | Calcium Nitrate | 8 |
| 1st Layer | First Infrared Light Sensitive Layer | Lime-Treated Gelatin | 587 |
| | | Light-Sensitive Silver Halide Emulsion (3) | 311 (in terms of silver) |
| | | Stabilizer (1) | 8 |
| | | Yellow Dye-donating Compound (1) | 504 |
| | | Sensitizing Dye (4) | 0.1 |
| | | Dye (a) | 44 |
| | | High Boiling Solvent (1) | 252 |
| | | Reducing Agent (1) | 35 |
| | | Antifoggant (3) | 4 |
| | | Surfactant (1) | 32 |
| | | Water-Soluble Polymer (2) | 46 |
| | | Hardener (1) | 45 |

Support: Paper Support Laminated with Polyethylene (thickness: 96 μm)

Note: Slight additives such as preservatives are omitted.

Surfactant (2)

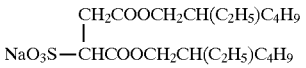

Surfactant (3)

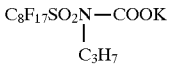

Surfactant (4)

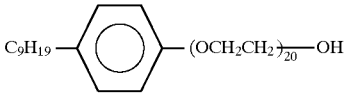

Water Soluble Polymer (1)

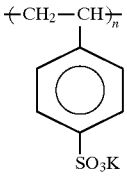

Limiting Viscosity Number
[η] = 1.6 (0.1N NaCl, 30° C.)
Molecular Weight: ca. 1000000

Water Soluble Polymer (2)

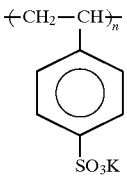

Limiting Viscosity Number
[η] = 0.8 (0.1N NaCl, 30° C.)
Molecular Weight: ca. 400000

Sensitizing Dye (4)

TABLE 17-continued

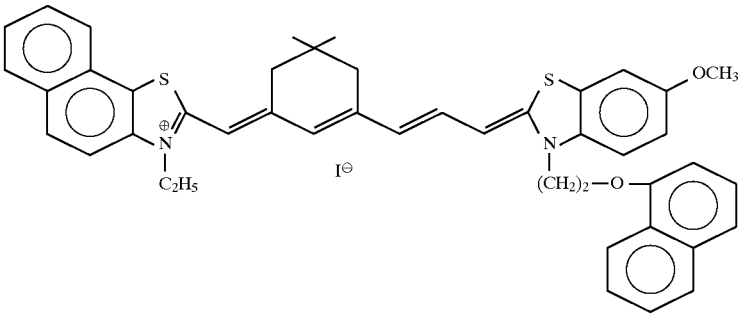

Antifoggant (5)

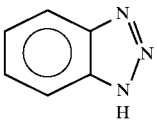

Hardener (1)
$CH_2{=}CHSO_2CH_2SO_2CH{=}CH_2$

Preparation of Light-Sensitive Materials 102 to 105

Light-sensitive materials 102 to 105 were prepared in the same manner as that for light-sensitive material 101, except that the 7th layer was prepared as shown in Table 18.

TABLE 18

| | Amount Coated ($mg/m^2$) | | | |
|---|---|---|---|---|
| Light-Sensitive Material No. | 102 | 103 | 104 | 105 |
| Acid-Treated Gelatin | 442 | 442 | 442 | 442 |
| Reducing Agent (2) | 47 | 12 | 12 | — |
| High Boiling Solvent (1) | 30 | 8 | 8 | — |
| Colloidal Silver Grains | 2 | 2 | 2 | 2 |
| Matte Agent (PMMA Resin) | 17 | 17 | 17 | 17 |
| Surfactant (2) | 16 | 16 | 16 | 16 |
| Surfactant (1) | 9 | 2 | 2 | — |
| Surfactant (5) | — | 40 | 8 | 8 |
| Surfactant (3) | — | — | — | — |
| Surfactant (6) | — | — | 32 | 32 |

Surfactant (5)

$$C_8F_{17}SO_2N(C_3H_7)-CH_2CH_2O(CH_2CH_2)_nH \quad n = 15$$

Surfactant (6)

$$C_{13}H_{27}CONHCH_2CH_2CH_2-\overset{CH_3}{\underset{CH_3}{\overset{|}{\underset{|}{N^+}}}}-CH_2COO^-$$

Then, light-sensitive materials 101 to 105 described above were exposed and treated as described below.

As a dye-fixing material, paper PGSG for Fujix Pictrography 3000 (manufactured by Fuji Photo Film Co. Ltd.) was used.

Further, the light-sensitive materials were subjected to uniform exposure of grey under the conditions shown in Table 19, using a laser exposure device described in JP-A-2-129625 and JP-A-2-54672.

TABLE 19

| | |
|---|---|
| Beam Intensity on Surface of Light-Sensitive Material | 1 mV |
| Density of Scanning Lines | 800 dpi/32 luster |
| Beam Width | 100 ± 10 μm in a main scanning direction<br>80 ± 10 μm in a subsidiary scanning direction |
| Exposure Time | 0.9 msec/luster |
| Exposure Wavelength | 670, 750, 810 nm (laser beam) |
| Exposure Amount | 1 logE/2.5 cm in a subsidiary scanning direction, change (max. 80 $erg/cm^2$, min. 1.2 $erg/cm^2$) |
| Method for Changing Exposure Amount | Modulation of emission time |

Each of the light-sensitive materials exposed was coated with water by two kinds of processes described below, and overlapped on the dye-fixing material. After heat development at 83° C. for 35 seconds, the light-sensitive material was separated from the dye-fixing material to obtain a gray image on the dye-fixing material.

Water-Coating Process (1) A light-sensitive material was conveyed in water heated to 40° C. in a dish-like container for a residence time of 3.5 seconds, and squeezed with silicone rubber rollers having an hardness of 400. The water content after squeezing is about 10 $g/m^2$.

(2) A light-sensitive material was coated with water so as to give a water content of about 10 $g/m^2$ by use of the water-coating device (310 in FIG. 3) described in this specification. In this case, the diameter of the nozzle holes 324 shown in FIG. 5 is controlled on the order of several tens to several hundreds microns, the displacement amount of the head plate 322 on the order of several tens microns, and the frequency thereof on the order of several kilohertz, thereby jetting water droplets having volumes shown in Table 20 to conduct water-coating.

The contact angle and the volume of water droplets was measured by taking a photograph of the state of the water droplets at the time of coating water in (2) described above at 25° C. with a high-speed video camera (200 frames/second) manufactured by Nac Inc., and observing it. The density unevenness was indicated by measuring the resulting gray image with an automatic recording densitometer, and evaluated taking as 100 the difference between the maximum magenta density and the minimum one of light-sensitive material 101 which was processed by the water-coating process (1).

TABLE 20

| Light-Sensitive Material No. | Water Coating Process | Contact Angle 0.5 Sec after Impact of Water Droplets (degree) | Volume of Water Droplets ($mm^3$) | Density Unevenness |
|---|---|---|---|---|
| 101 (Comparison) | (1) | — | — | 100 |
| 101 (Comparison) | (2) | 75 | 0.008 | 150 |
| 102 (Comparison) | (2) | 57 | 0.014 | 150 |
| 102 (Comparison) | (2) | 57 | 0.008 | 115 |
| 102 (Comparison) | (2) | 57 | 0.0005 | 98 |
| 103 (Comparison) | (2) | 43 | 0.014 | 120 |
| 103 (Invention) | (2) | 43 | 0.008 | 80 |
| 103 (Invention) | (2) | 43 | 0.0005 | 68 |
| 104 (Comparison) | (2) | 34 | 0.014 | 110 |
| 104 (Invention) | (2) | 34 | 0.008 | 75 |
| 104 (Invention) | (2) | 34 | 0.0005 | 60 |
| 105 (Comparison) | (2) | 25 | 0.014 | 105 |
| 105 (Invention) | (2) | 25 | 0.008 | 72 |
| 105 (Invention) | (2) | 25 | 0.0005 | 55 |

Table 20 reveals that the samples obtained by the image forming process of the present invention are decreased in density unevenness, and very excellent.

Further, light-sensitive material 106 was prepared in the same manner as that for light-sensitive material 101, except that the 7th layer was divided into two layers as shown in Table 21. Light-sensitive material 106 thus obtained was 28 degrees in the contact angle 0.5 second after the impact of water droplets and decreased in density unevenness. Thus, light-sensitive material 106 was excellent.

TABLE 21

| Additive | Amount Coated ($mg/m^2$) 7th Layer | 8th Layer |
|---|---|---|
| Acid-Treated Gelatin | 111 | 331 |
| Reducing Agent (2) | 47 | — |
| High Boiling Solvent (1) | 30 | — |
| Colloidal Silver Grains | 2 | — |
| Matte Agent (PMMA Resin) | — | 17 |
| Surfactant (2) | 8 | 8 |
| Surfactant (1) | 9 | — |
| Surfactant (5) | — | 32 |
| Surfactant (3) | — | — |
| Surfactant (6) | — | 8 |

Further, in Table 20, the following water-coating process (3) was used instead of water-coating process (2). As a result, a similar effect was obtained.

(3) The water-coating device (310 in FIG. 3) described in this specification was equipped with silicone rubber rollers (squeeze rollers) having a hardness of 40° on the side opposite to the conveying rollers 69 of the conveying rollers 68. Using this device, coating of a light-sensitive material with water was conducted so as to give a water content of about 30 $g/m^2$, followed by squeezing with the squeeze rollers so as to give a water content of about 10 $g/m^2$.

Furthermore, the use of light-sensitive materials described in examples of JP-A-7-261353 also provided a similar effect.

While the invention has been described in detail and with reference to specific embodiments thereof, it will be apparent to one skilled in the art that various changes and modifications can be made therein without departing from the spirit and scope thereof.

What is claimed is:

1. An image forming process comprising the steps of:

imagewise-exposing a heat developable light-sensitive material comprising a support having thereon at least a light-sensitive silver halide, a binder and a dye-donating compound, wherein the dye-donating compound forms or releases a diffusive dye corresponding or reversely corresponding to a reduction reaction of the silver halide into silver;

supplying water to the exposed material;

heat developing the water-supplied material to form a diffusive dye image therein; and transferring the diffusive dye image onto a dye-fixing element, wherein the water-supplying step comprises jetting of a water droplet having a volume of not more than 0.01 $mm^3$, and the light-sensitive material has a contact angle of not more than 50 degrees as determined at 0.5 second after the impact of the water droplet onto the light-sensitive material.

2. The image forming process of claim 1, wherein the process is carried out while conveying the heat developable light-sensitive material.

3. The image forming process of claim 1, wherein the water-supplying step is conducted by using a water-coating device comprising:

(A) a tank for reserving water, which tank has a side wall facing the conveying path of the heat developable light-sensitive material;

(B) a nozzle which is incorporated in the side wall of the tank, and comprises a plurality of nozzle holes for jetting water, the nozzle holes being linearly arranged at a definite interval along a direction intersecting the conveying direction of the heat developable light-sensitive material; and (C) an actuator for moving the nozzle toward the heat developable light-sensitive material on the conveying path.

* * * * *